US009716341B2

(12) United States Patent
Yamane et al.

(10) Patent No.: US 9,716,341 B2
(45) Date of Patent: Jul. 25, 2017

(54) LEVER-TYPE CONNECTOR ASSEMBLY

(71) Applicants: Tyco Electronics Japan G.K., Kanagawa (JP); Toyota Jidosha Kabushiki Kaisha, Aichi-ken (JP)

(72) Inventors: Tomokazu Yamane, Kanagawa (JP); Hiroki Kondo, Kanagawa (JP); Tetsuya Yamashita, Kanagawa (JP); Shingo Yamada, Kanagawa (JP); Noritaka Ikejiri, Aichi-ken (JP)

(73) Assignees: Toyota Jidosha Kabushiki Kaisha, Aichi-ken (JP); Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 15/340,438

(22) Filed: Nov. 1, 2016

(65) Prior Publication Data

US 2017/0133790 A1 May 11, 2017

(30) Foreign Application Priority Data

Nov. 10, 2015 (JP) ..... 2015-220488

(51) Int. Cl.
*H01R 13/62* (2006.01)
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/62933; H01R 13/62938; H01R 13/62955; H01R 13/514; H01R 4/4836
USPC ..... 439/157, 372, 701, 724
See application file for complete search history.

(56) References Cited

U.S. PATENT DOCUMENTS 8,142,232 B1 * 3/2012 Song ..... H01R 13/514 439/701
8,734,170 B2 5/2014 Ikeda et al.
2008/0214039 A1 * 9/2008 Ciriello ..... H01R 13/62977 439/347
2011/0250770 A1 * 10/2011 Suzuki ..... H01R 13/193 439/157
2011/0312198 A1 * 12/2011 Komiyama ..... H01R 13/62977 439/157

(Continued)

*Primary Examiner* — Abdullah Riyami
*Assistant Examiner* — Thang Nguyen
(74) *Attorney, Agent, or Firm* — Barley Snyder

(57) ABSTRACT

A connector assembly is disclosed including a first connector and a second connector matable with the first connector. The first connector has a first housing, a first power terminal attached, and a first signal terminal. The second connector has a lever attached to a moving housing, the lever moving the moving housing between a mating released position, an intermediate position, and a mating completed position, a second housing movably disposed within the moving housing, a second power terminal disposed in the second housing and contacting the first power terminal in the intermediate position, a second signal terminal attached to the moving housing and contacting the first signal terminal at a position between the intermediate position and the mating completed position, and a separating protrusion disposed on the moving housing preventing the second power terminal from contacting the first power terminal in the mating released position.

15 Claims, 22 Drawing Sheets

(56) References Cited

U.S. PATENT DOCUMENTS

2014/0199876 A1* 7/2014 Kato ..... H01R 13/4538
439/352

* cited by examiner

LEVER-TYPE CONNECTOR ASSEMBLY

CROSS-REFERENCE TO RELATED APPLICATION

This application claims the benefit of the filing date under 35 U.S.C. §119(a)-(d) of Japanese Patent Application No. 2015-220488, filed on Nov. 10, 2015.

FIELD OF THE INVENTION

The present invention relates to a connector assembly, and more particularly, to a lever-type connector assembly.

BACKGROUND

On a vehicle in which a high-voltage battery is mounted, such as an electric vehicle or a hybrid vehicle, a connector assembly is used for disconnecting a high-voltage portion of the battery. A conventional connector assembly of this type is disclosed in JP 2013-62043 A.

The connector assembly disclosed in JP 2013-62043 A is a lever-type connector assembly. The rotating operation of a lever moves a second connector to be mated with a first connector or separates the second connector from the first connector. The first connector includes a first power terminal of a power circuit and a first signal terminal of a signal circuit. The second connector includes a second power terminal and a second signal terminal. The second power terminal is connected with the first power terminal and the second signal terminal is connected with the first signal terminal when the second connector is mated with the first connector.

In the lever-type connector assembly of JP 2013-62043 A, when the second connector is separated from the first connector, a predetermined time lag is provided between the time when a first signal terminal and a second signal terminal are disconnected and the time when a first power terminal and a second power terminal are disconnected. The current to the power circuit is stopped first by releasing the connection between the first signal terminal and the second signal terminal included in the signal circuit. Then, the connection of the first power terminal and the second power terminal included in the power circuit is released, in order to protect an operator from an electrical shock.

In the lever-type connector assembly disclosed in JP 2013-62043 A, however, the following drawback has been found. Both the second signal terminal and the second power terminal are secured to a connector body of the second connector. When the second connector is mated with the first connector, the second power terminal slides into contact with the first power terminal, and when the second connector is separated from the first connector, the second power terminal slides out of contact with the first power terminal. Due to the sliding at both mating and separation, the second power terminal and the first power terminal may be damaged.

SUMMARY

An object of the invention, among others, is to provide a connector assembly in which, in separating a second connector from a first connector, terminals of the first and second connectors are prevented from being damaged. The disclosed connector assembly includes a first connector and a second connector matable with the first connector. The first connector has a first housing, a first power terminal attached to the first housing, and a first signal terminal attached to the first housing. The second connector has a lever attached to a moving housing, the lever moving the moving housing between a mating released position, an intermediate position, and a mating completed position, a second housing movably disposed within the moving housing, a second power terminal disposed in the second housing and contacting the first power terminal in the intermediate position, a second signal terminal attached to the moving housing and contacting the first signal terminal at a position between the intermediate position and the mating completed position, and a separating protrusion disposed on the moving housing preventing the second power terminal from contacting the first power terminal in the mating released position.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a connector assembly. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
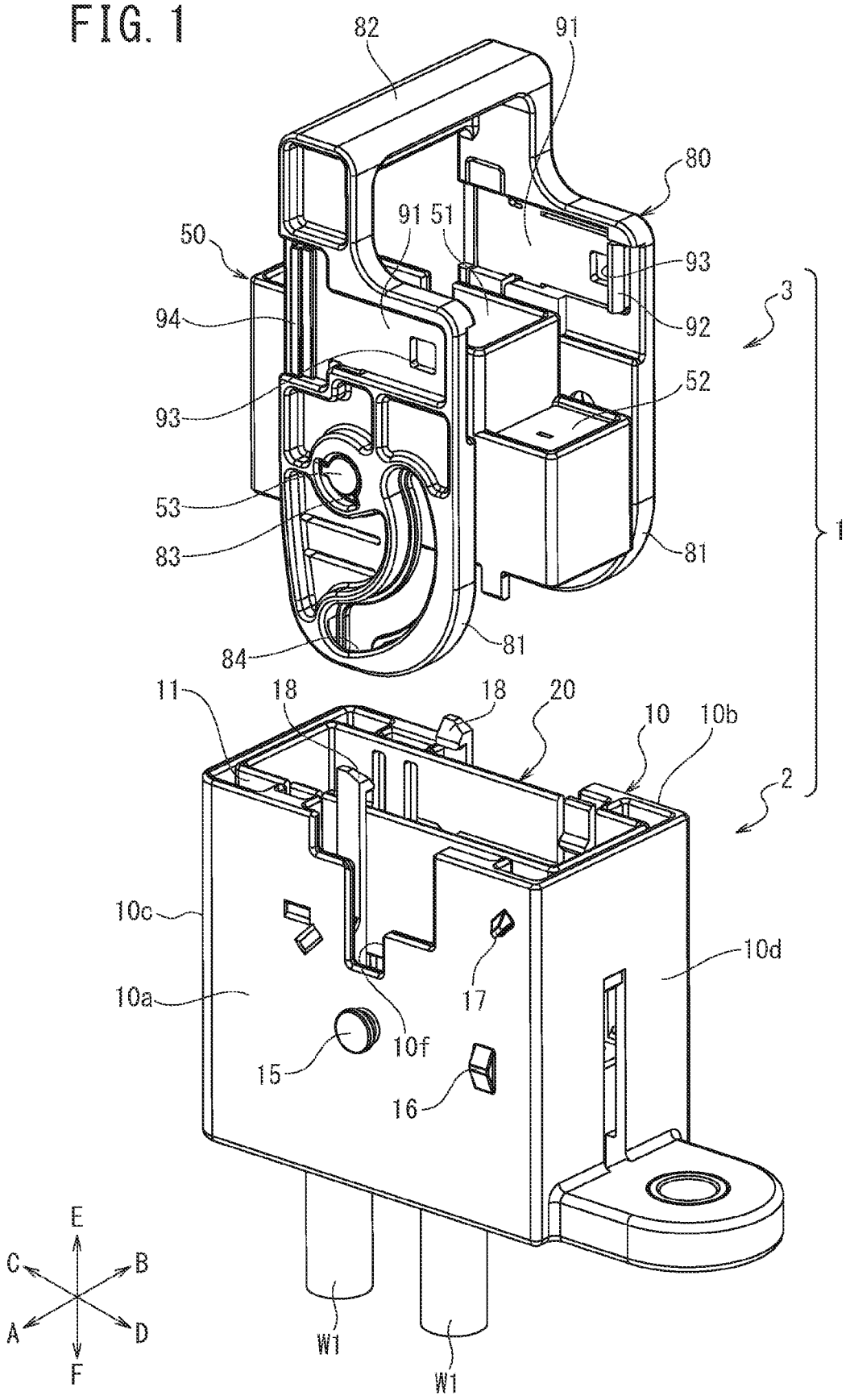
FIG. 1 is a perspective view of a connector assembly according to the invention before a second connector is mated with a first connector.

A connector assembly 1 according to the invention is shown generally in FIG. 1. The connector assembly 1 includes a first connector 2 and a second connector 3 to be mated with the first connector 2. The major components of the invention will now be described in greater detail.

Figure 5:
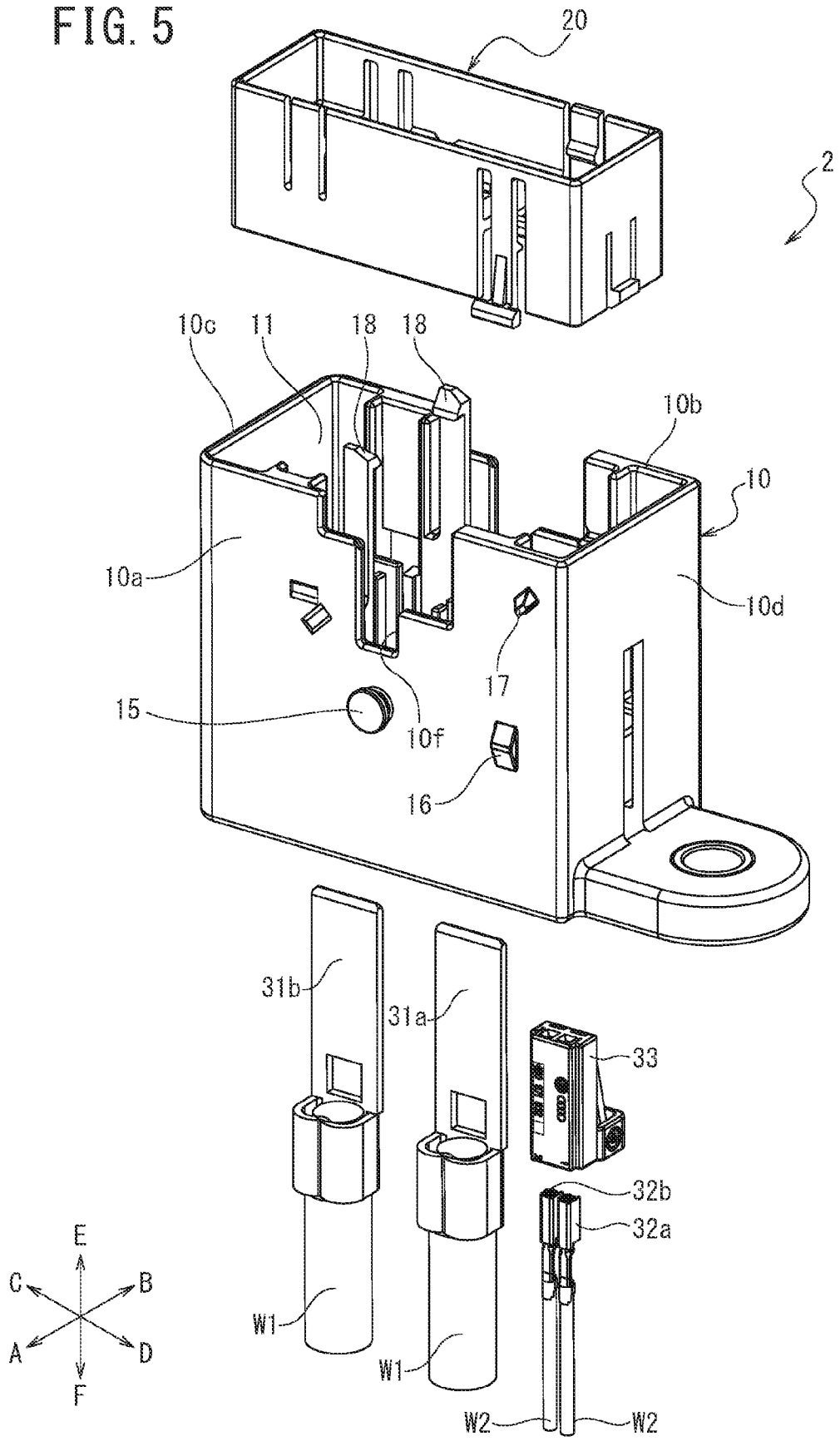
FIG. 5 is an exploded perspective view of the first connector of the connector assembly of FIG. 1.

The first connector 2 is shown generally in FIG. 5. The first connector 2 includes a first housing 10, a spacer 20, a pair of first power terminals 31*a* and 31*b*, and a pair of first signal terminals 32*a* and 32*b*.

As shown in FIG. 5, the first housing 10 has a substantially rectangular parallelepiped shape extending in a front-rear direction as indicated by an arrow AB, in a left-right direction as indicated by an arrow CD, which is perpendicular to the front-rear direction, and in an upper-lower direction as indicated by an arrow EF, which is perpendicular to the front-rear direction and the left-right direction. The first housing 10 is formed by molding an insulating synthetic resin. Herein, an arrow A indicates a front direction, an arrow B indicates a rear direction, an arrow C indicates a left direction, an arrow D indicates a right direction, an arrow E indicates an upper direction, and an arrow F indicates a lower direction. Hereinafter, the directions as described above will be used throughout the specification.

Figure 14:
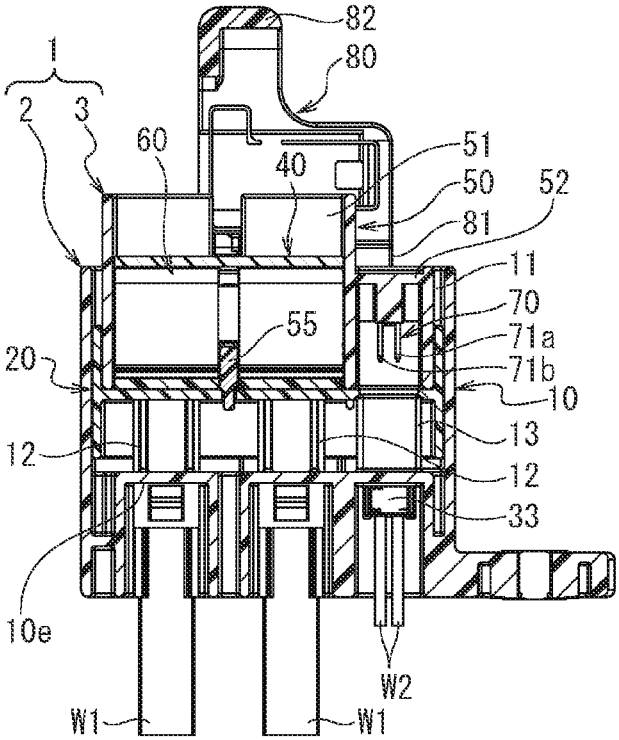
FIG. 14 is a side sectional view of the connector assembly of FIG. 13.
Figure 15:
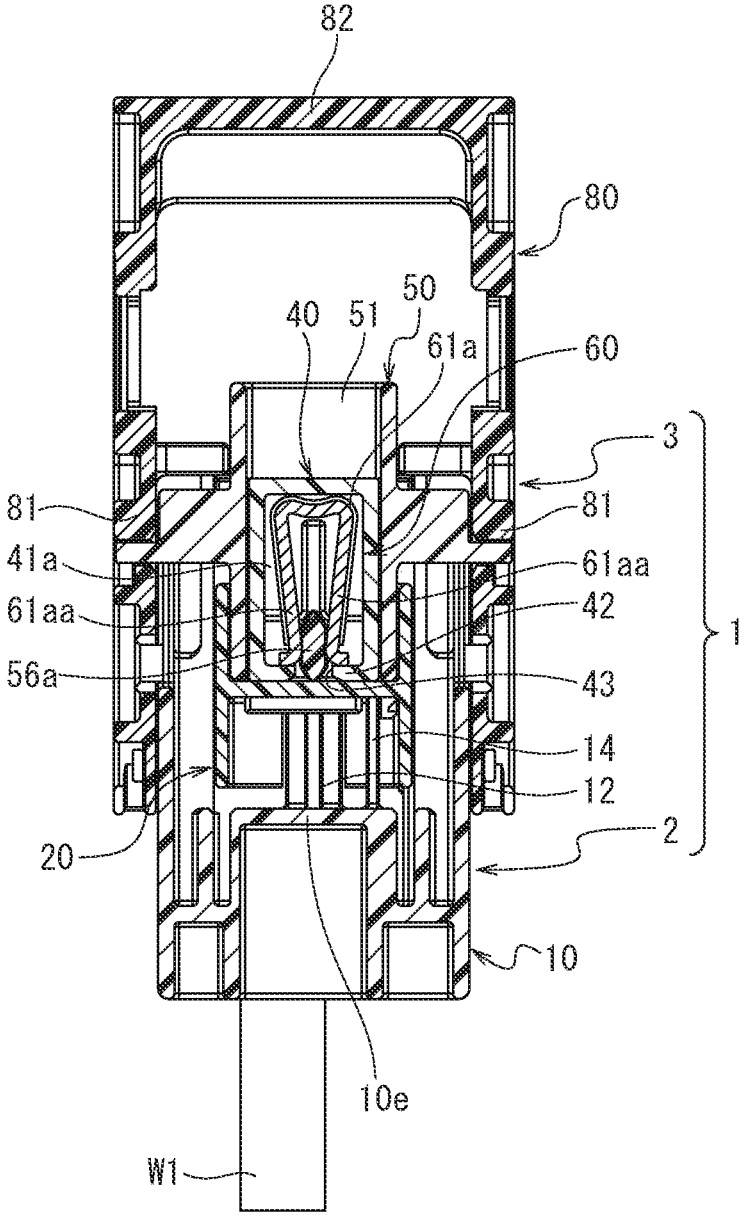
FIG. 15 is a front sectional view of the connector assembly of FIG. 13.
Figure 16:
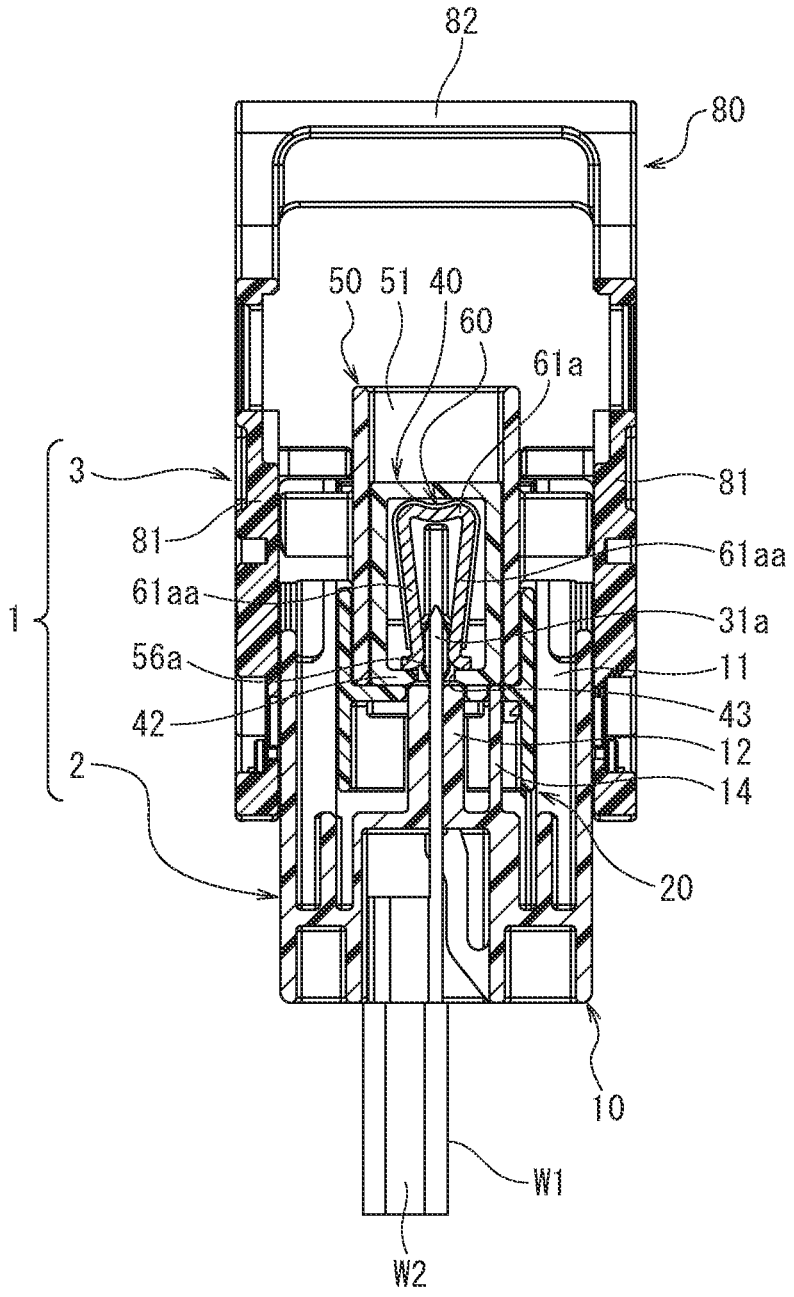
FIG. 16 is another front sectional view of the connector assembly of FIG. 13.
Figure 18:
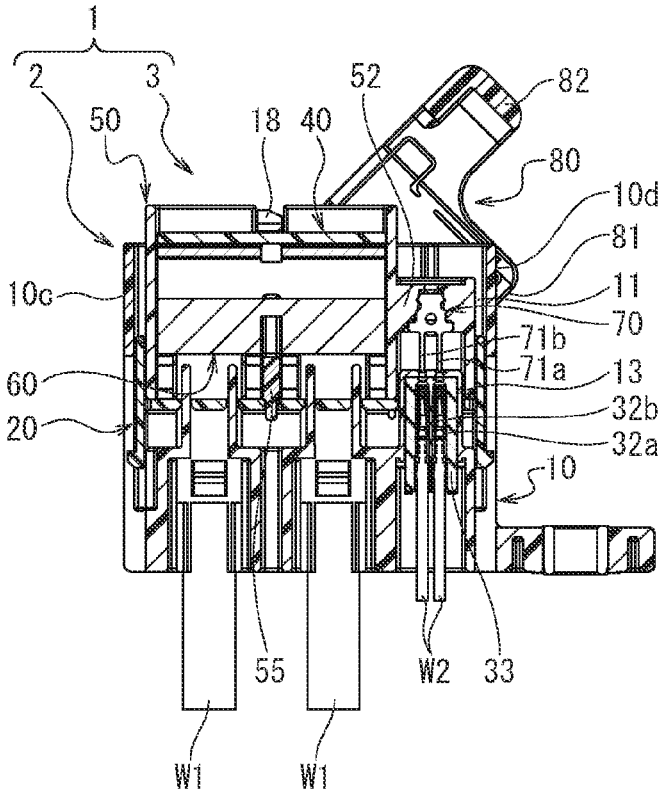
FIG. 18 is a side sectional view of the connector assembly of FIG. 17.
Figure 21:
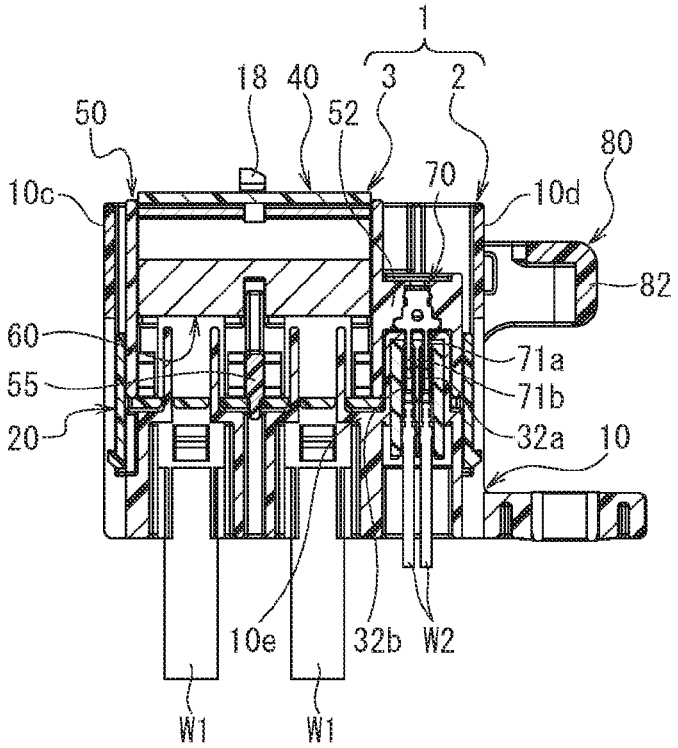
FIG. 21 is a side sectional view of the connector assembly of FIG. 20.

The first housing 10 includes a front wall 10*a*, a rear wall 10*b*, a left wall 10*c*, a right wall 10*d*, and a bottom wall 10*e*, so that a second connector receiving recess 11 that opens on its top face is defined. The bottom wall 10*e* includes a first power terminal attachment 12, as shown in FIGS. 14-16, and a first signal terminal attachment 13, as shown in FIGS. 14, 18, and 21. The bottom wall 10*e* also includes a second housing insertion restricting portion 14, as shown in FIGS. 15 and 16.

Figure 2:
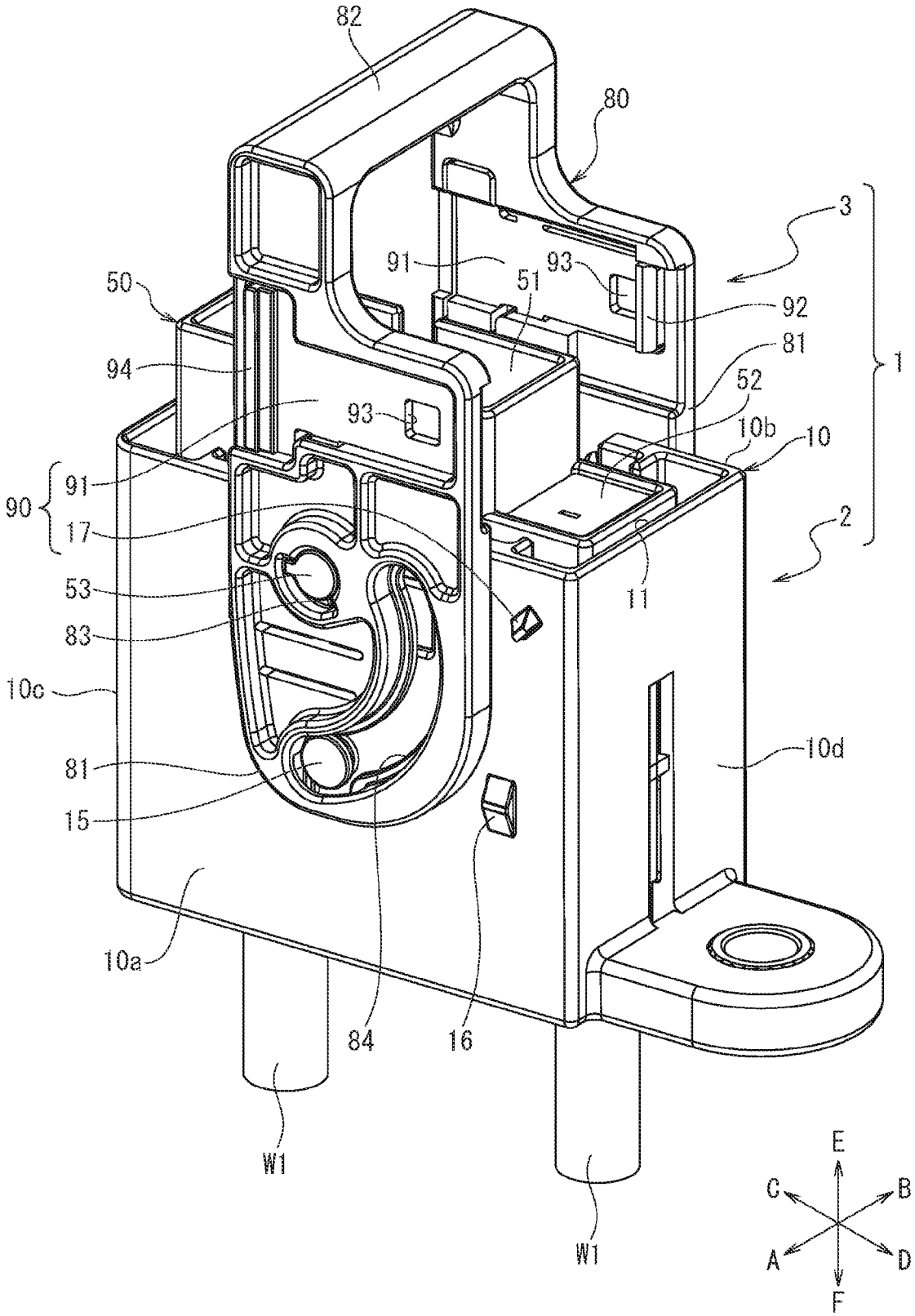
FIG. 2 is a perspective view of the connector assembly of FIG. 1 with a lever located at a lever mating released position and a moving housing located at a mating released position.

As shown in FIGS. 1 and 5, a pair of notches 10*f* that are respectively cut away at substantially center parts in the left-right direction of upper edges are arranged at the front wall 10*a* and the rear wall 10*b* of the housing 10. As shown in FIGS. 1, 2, and 5, a pair of cam shafts 15 (only a cam shaft on the front side is illustrated) project from the first housing 10 and are respectively arranged on lower sides of the notches 10*f* at the front wall 10*a* and the rear wall 10*b* of the first housing 10.

As shown in FIGS. 1, 5, 24, and 25, near the right ends of the front wall 10*a* and the rear wall 10*b* of the housing 10, a pair of signal terminal contact projections 16 are respectively provided at positions nearly the same height as the height of the cam shafts 15 in the upper-lower direction. Further, near the right ends of the front wall 10*a* and the rear wall 10*b* of the housing 10, a pair of time lag projections 17 are respectively provided at positions closer to the top of the first housing 10 than the signal terminal contact projections 16.

As shown in FIGS. 1, 3, 5, 28, and 29, a pair of second housing lock portions 18 are respectively provided at substantially center parts in the left-right direction of the first front wall 10*a* and the rear wall 10*b* of the housing 10.

The spacer 20, as shown in FIG. 5, is configured to protect an operator from an electrical shock that is caused by touching the first power terminal 31*a* or 31*b* attached at the first housing 10. The spacer 20 is formed such that its contour is shaped along the front wall 10*a*, the rear wall 10*b*, the left wall 10*c*, the right wall 10*d*, and the bottom wall 10*e* of the housing 10. The spacer 20 is provided to be movable in the upper-lower direction in the second connector receiving recess 11 of the first housing 10. The spacer 20 is formed by molding an insulating synthetic resin.

As shown in FIG. 5, each of the pair of first power terminals 31*a* and 31*b* is made of a male tab terminal, for example, and is crimp-connected to an electrical wire W1. Each of the pair of first power terminals 31*a* and 31*b* is made by stamping and forming a metal plate. The first power terminals 31*a* and 31*b* are attached to the first power terminal attachment 12 of the first housing 10, such that contact portions of the first power terminals 31*a* and 31*b* protrude inward in the second connector receiving recess 11, as shown in FIG. 16.

As shown in FIG. 5, each of the pair of first signal terminals 32*a* and 32*b* is made of a female contact, for example, and is crimp-connected to an electrical wire W2. Each of the pair of first signal terminals 32*a* and 32*b* is made by stamping and forming a metal plate. The first signal terminals 32*a* and 32*b* are disposed in a signal terminal accommodation housing 33. As shown in FIGS. 14 and 18, the signal terminal accommodation housing 33 in which the first signal terminals 32*a* and 32*b* are disposed is attached to the first signal terminal attachment 13 of the first housing 10.

Figure 6:
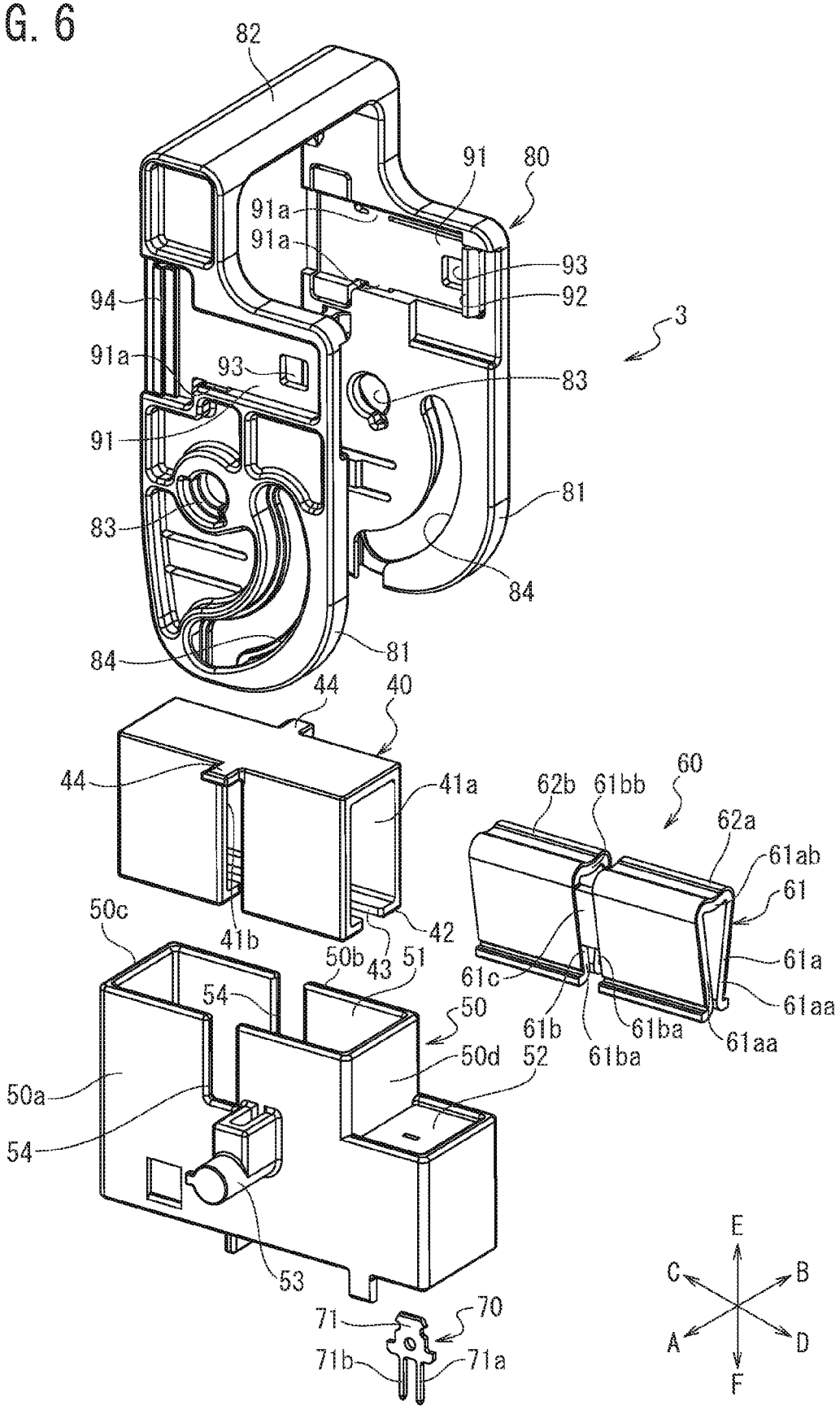
FIG. 6 is an exploded perspective view of the second connector.

The second connector 3 is shown generally in FIG. 6. The second connector 3 is a lever-type connector, and includes a second housing 40, a moving housing 50, separating protrusions 56*a* and 56*b*, a second power terminal 60, a second signal terminal 70, and the lever 80.

As shown in FIG. 6, the second housing 40 has a substantially square tube shape extending to be longer in the left-right direction. A first accommodation cavity 41*a* is arranged on the right side and a second accommodation cavity 41*b* is arranged on the left side, in the inside of the second housing 40. The first accommodation cavity 41*a* and the second accommodation cavity 41*b* communicate with each other to penetrate through the second housing 40 between the left end and the right end. On a bottom wall 42 of the second housing 40, a slit 43 extends to be long and narrow between the left end and the right end of the bottom wall 42. The slit 43 penetrates through the bottom wall 42 in the upper-lower direction. In addition, at center parts in the left-right direction of a front edge and a rear edge of the top wall of the second housing 40, a pair of lock plate portions 44 are respectively formed to protrude frontward and rearward. The second housing 40, as shown in FIG. 16, is configured to abut upper ends of the first power terminal attachment 12 and the second housing insertion restricting portion 14, when the second housing 40 is inserted into the second connector receiving recess 11 of the first housing 10. This configuration restricts the movement of the second housing 40 in the lower direction, which is the insertion direction.

Figure 8:
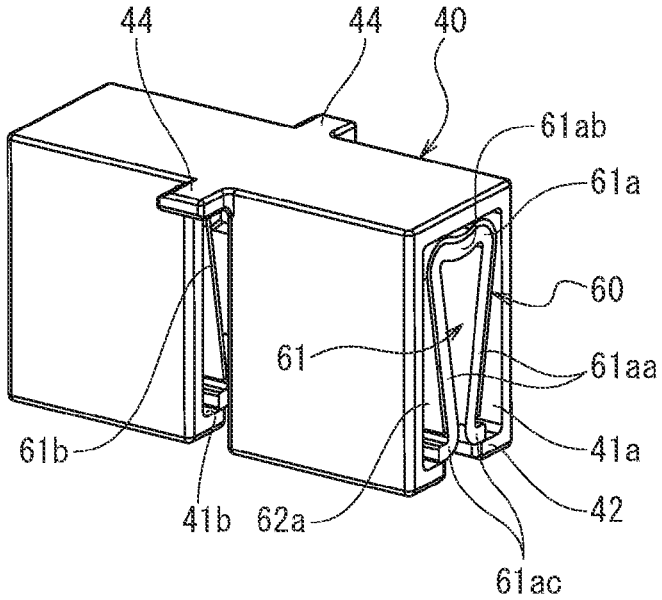
FIG. 8 is a perspective view of a second power terminal and a second housing of the second connector.

As shown in FIG. 6, the second power terminal 60 includes a terminal body 61, and a pair of reinforcing plate springs 62*a* and 62*b*. The terminal body 61 is made by stamping and forming a metal plate. The terminal body 61 includes a first terminal portion 61*a*, a second terminal portion 61*b*, and a coupling portion 61*c* configured to couple the first terminal portion 61*a* and the second terminal portion 61*b*. The first terminal portion 61*a* includes a pair of elastic contact arms 61*aa*, and a top plate portion 61*ab* configured to couple the pair of elastic contact arms 61*aa*. The top plate portion 61*ab* gives elasticity to each of the elastic contact arms 61*aa*. The pair of elastic contact arms 61*aa* receive and contact the first power terminals 31*a* made of a male tab terminal between the pair of elastic contact arms 61*aa*. On the other hand, the second terminal portion 61*b* includes a pair of elastic contact arms 61*ba*, and a top plate portion 61*bb* configured to couple the pair of elastic contact arms 61*ba*. The top plate portion 61*bb* gives elasticity to each of the elastic contact arms 61*ba*. The pair of elastic contact arms 61*ba* receive and contact the first power terminals 31*b* made of a male tab terminal between the pair of elastic contact arms 61*ba*. As shown in FIG. 6, the reinforcing plate spring 62*a* of the pair of reinforcing plate springs 62*a* and 62*b* is attached to the first terminal portion 61*a* to cover the outer circumference of the first terminal portion 61*a*. The reinforcing plate spring 62*b* of the pair of reinforcing plate springs 62*a* and 62*b* is attached to the second terminal portion 61*b* to cover the outer circumference of the second terminal portion 61*b*. As shown in FIG. 8, the second power terminal 60 is disposed in the second housing 40, such that the first terminal portion 61*a* is located in the first accommodation cavity 41*a* and the second terminal portion 61*b* is located in the second accommodation cavity 41*b*. Curved portions 61*ac* that curve outward arranged at ends of the respective elastic contact arms 61*aa* are provided on the bottom wall 42 of the second housing 40. Although not illustrated, curved portions that curve outward arranged at ends of the respective elastic contact arms 61*ba* are provided on the bottom wall 42 of the second housing 40.

As shown in FIG. 6, the moving housing 50 includes a front wall 50*a*, a rear wall 50*b*, a left wall 50*c*, and a right wall 50*d*, so as to define a second housing receiving space 51 penetrating through the moving housing 50 in the upper-lower direction. Also, the moving housing 50 includes a second signal terminal attachment 52 protruding to the right from the right wall 50*d*. The moving housing 50 is formed by molding an insulating synthetic resin.

Figure 10:
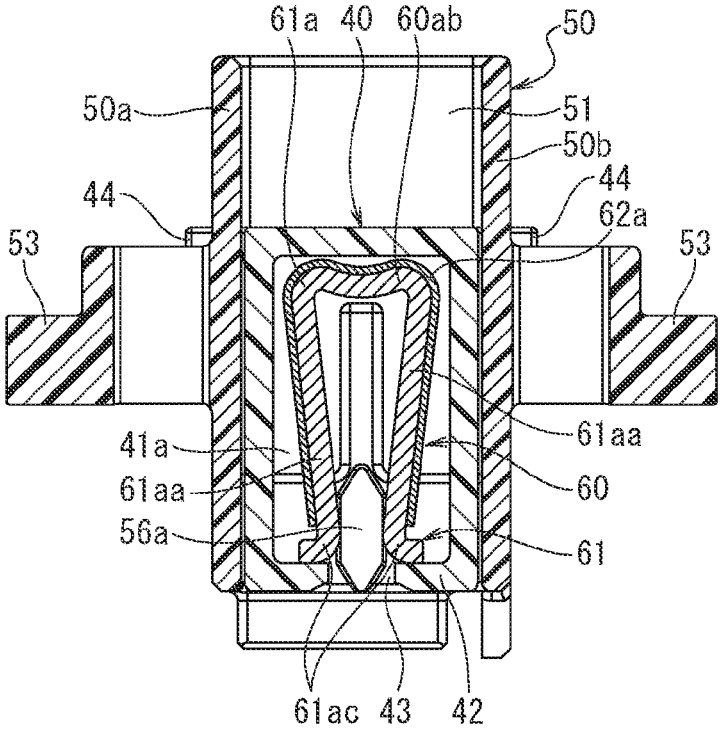
FIG. 10 is a sectional view taken along line 10-10 in FIG. 9.
Figure 11:
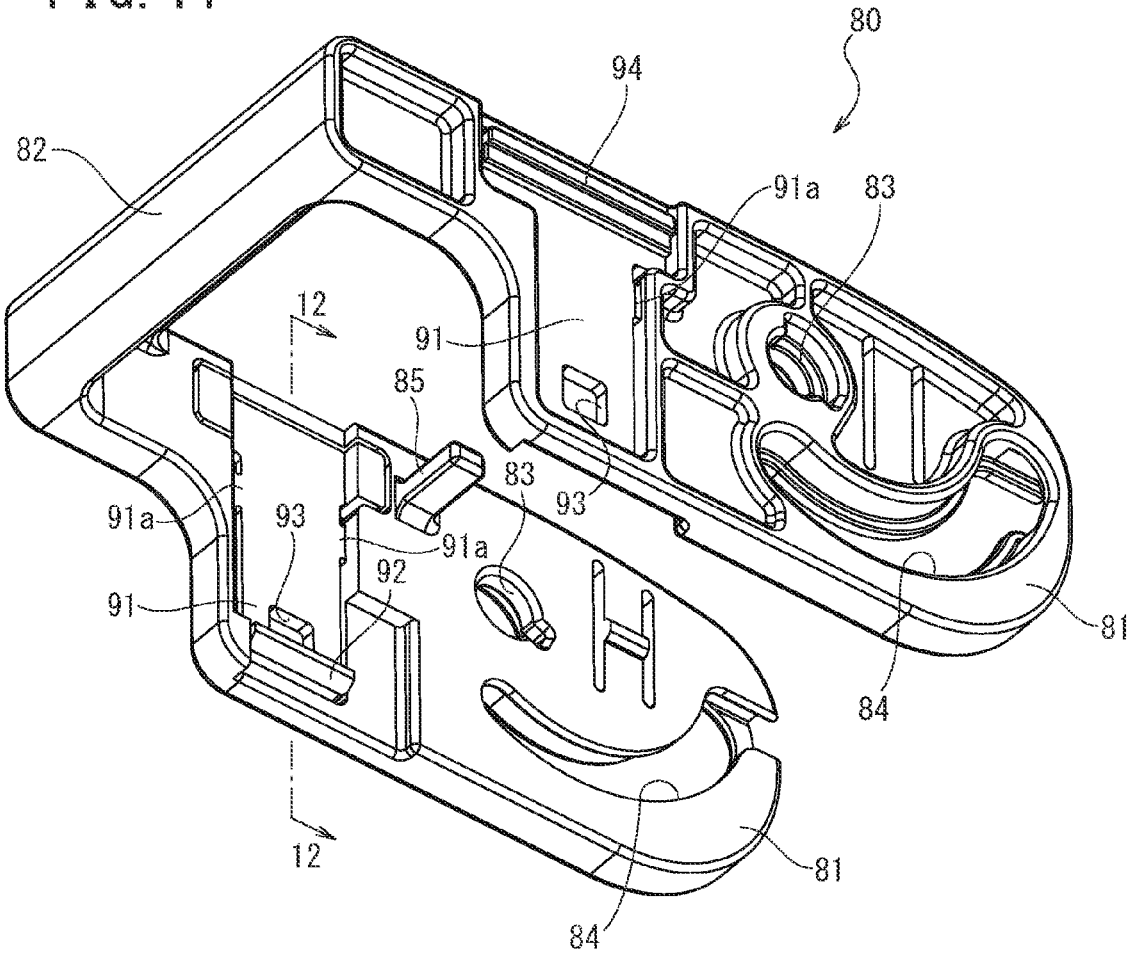
FIG. 11 is a perspective view of the lever.
Figure 12:
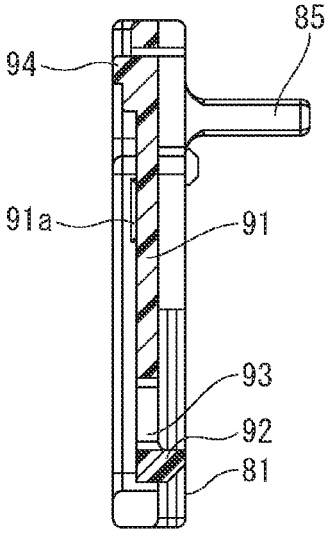
FIG. 12 is a sectional view taken along line 12-12 in FIG. 11.

On the front wall 50*a* and the rear wall 50*b* of the moving housing 50, as shown in FIGS. 6 and 10, a pair of spindles 53 are formed to protrude and support the lever 80 to be capable of rotating the lever 80. In addition, a pair of notches 54 that are cut away to extend downward from an upper edge are respectively arranged at the substantially center parts in the left-right direction of the front wall 50*a* and the rear wall 50*b* of the moving housing 50.

Figure 9:
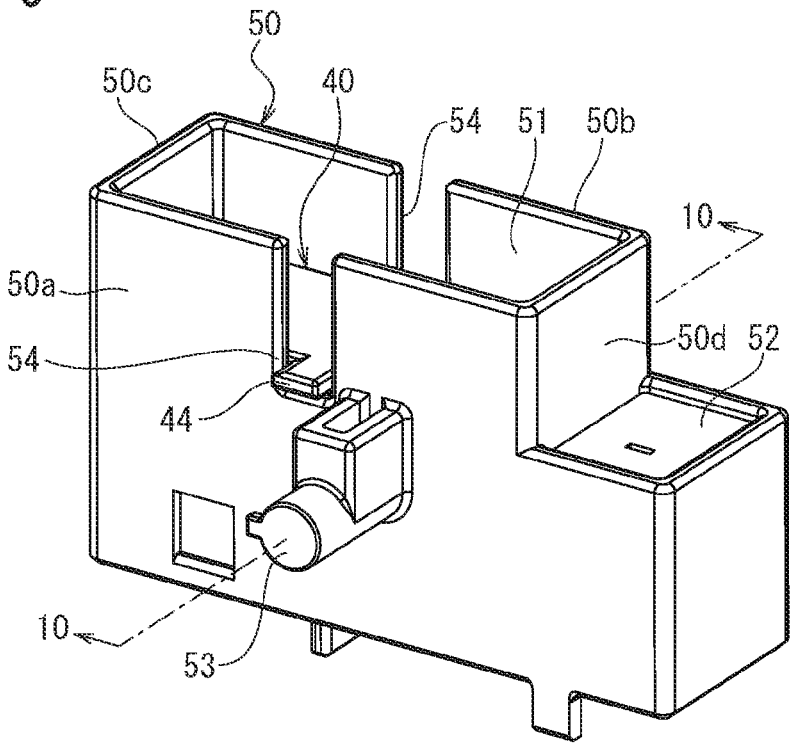
FIG. 9 is a perspective view of the second housing and the moving housing.

As shown in FIGS. 9 and 10, the second housing 40 in which the second power terminal 60 is disposed is movably disposed in the upper-lower direction in the second housing receiving space 51. The second housing 40, however, is disposed in the second housing receiving space 51 with the pair of lock plate portions 44 arranged at the top wall being mounted on the lower ledges of the notches 54, so that the downward movement of the second housing 40 is restricted in the moving housing 50.

As shown in FIG. 10, the separating protrusion 56*a*, as will be described later, provided on the moving housing 50 enters a space between the pair of elastic contact arms 61*aa* of the second power terminal 60, and pushes out a space between the pair of elastic contact arms 61*aa*. Also, the separating protrusion 56*b* enters a space between the pair of elastic contact arms 61*ba* of the second power terminal 60, and pushes out a space between the pair of elastic contact arms 61*ba*. Hence, the upward movement of the second power terminal 60 is restricted in the moving housing 50. Additionally, the curved portions 61*ac* that curve outward arranged at the respective ends of the elastic contact arms 61*aa* are provided on the bottom wall 42 of the second housing 40. The curved portions that curve outward arranged at the respective ends of the elastic contact arms 61*ba* are provided on the bottom wall 42 of the second housing 40. Hence, the upward movement of the second housing 40 is restricted by the second power terminal 60. As a result, the upward movement of the second housing 40 is restricted in the moving housing 50. Thus, in a state where the second housing 40 that houses the second power terminal 60 is housed in the moving housing 50, the upward and downward movements of the second power terminal 60 and the second housing 40 are restricted in the moving housing 50.

As will be described later, when the downward movement of the second housing 40 is restricted, it is assumed that a greater force be exerted downward onto the moving housing 50 than frictional forces of the separating protrusions 56*a* and 56*b* exerted onto the pair of elastic contact arm 61*aa* and 61*ba*. Then, the moving housing 50 is capable of moving downward. In other words, the moving housing 50 houses the second housing 40 to be capable of moving with respect to the second housing 40.

When the second connector 3 is mated with the first connector 2, the moving housing 50 is inserted into the second connector receiving recess 11 of the first housing 10 in the inside of the spacer 20, with housing the second housing 40 and the second power terminal 60. In such a situation, as described above, the second housing 40 abuts the upper ends of the first power terminal attachment 12 and the second housing insertion restricting portion 14 of the first housing 10. This configuration restricts the downward movement, which is the insertion direction of the second housing 40.

The moving housing 50 moves between a mating released position that is located at the time when the second housing 40 is inserted into the first housing 10, shown in FIGS. 2 and 13-16, an intermediate position shown in FIGS. 3 and 17-19, and a mating completed position shown in FIGS. 4 and 20-22. The intermediate position is located on the depth side (i.e., lower side) in the insertion direction from the mating released position. The mating completed position is located on the depth side in the insertion direction from the intermediate position. Here, when the moving housing 50 moves from the mating released position to the intermediate position, it is necessary to exert a greater force downward onto the moving housing 50 than the frictional forces of the separating protrusions 56*a* and 56*b* respectively exerted to the pair of elastic contact arms 61*aa* and 61*ba*. On the other hand, when the moving housing 50 moves from the intermediate position to the mating released position, it is necessary to exert a greater force upward onto the moving housing 50 than the frictional forces of the separating protrusions 56*a* and 56*b* respectively exerted to the pair of elastic contact arms 61*aa* and 61*ba*.

Figure 7:
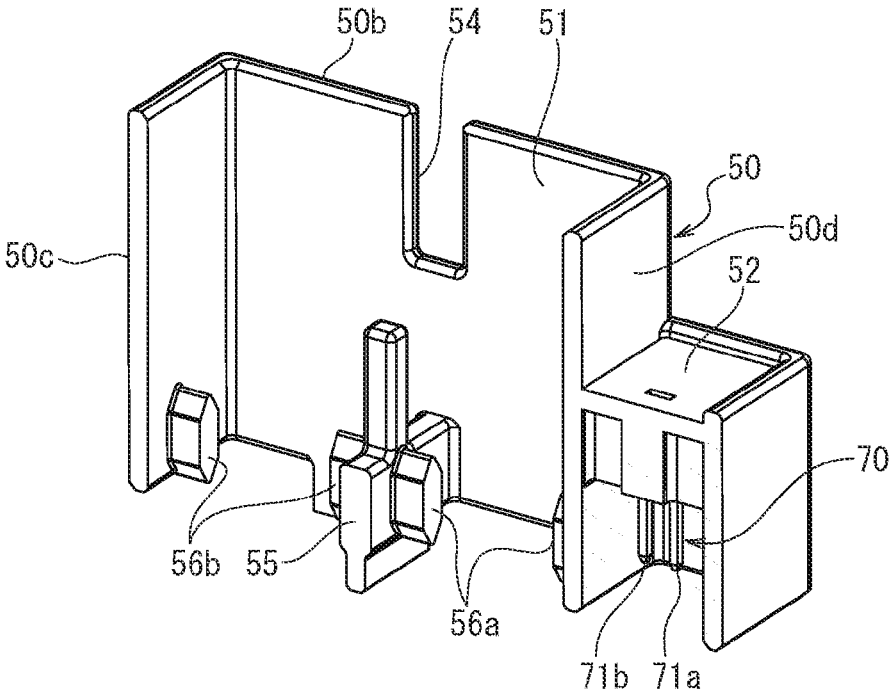
FIG. 7 is a sectional perspective view of the moving.

Next, the separating protrusions 56*a* and 56*b* will be described. As shown in FIG. 7, a partition wall 55 extending between the rear wall 50*b* and the front wall 50*a* is arranged at the center part in the left-right direction of the rear wall 50*b* of the moving housing 50. A pair of the separating protrusions 56*a* opposing each other are arranged on the right side of the partition wall 55 and on the left side of the right wall 50*d*. A pair of the separating protrusions 56*b* opposing each other are arranged on the left side of the partition wall 55 and on the right side of the left wall 50*c*. Each of the separating protrusions 56*a* and 56*b* is made of a protrusion protruding from the wall face and elongated in the upper-lower direction. The separating protrusions 56*a* and 56*b* are arranged in line in the left-right direction.

When the moving housing 50 is inserted into the second connector receiving recess 11, the separating protrusion 56*a* of the separating protrusions 56*a* and 56*b* enters the space between the pair of elastic contact arms 61*aa* of the second power terminal 60, and pushes out the space between the pair of elastic contact arms 61*aa*. This configuration allows the first power terminal 31*a* to enter the space between the pair of elastic contact arms 61*aa* without contacting the elastic contact arms 61*aa*. The width of the protrusion of the separating protrusion 56*a* is greater than the thickness of the first power terminal 31*a* made of a tab terminal.

When the moving housing 50 is inserted into the second connector receiving recess 11, the moving housing 50 reaches the mating released position shown in FIG. 15. Then, the separating protrusion 56*a* enters the space between the pair of elastic contact arms 61*aa* of the second power terminal 60, and keeps pushing out the space between the pair of elastic contact arms 61*aa*. As shown in FIG. 16, when the moving housing 50 is located at the mating released position, the pair of elastic contact arms 61*aa* are prevented from contacting the first power terminal 31*a*.

Also, when the moving housing 50 is inserted into the second connector receiving recess 11, the separating protrusion 56*b* enters the space between the pair of elastic contact arms 61*ba* of the second power terminal 60, and pushes out the space between the pair of elastic contact arms 61*ba*. Accordingly, the first power terminal 31*b* enters the space between the pair of elastic contact arms 61*ba* without contacting the elastic contact arms 61*aa*. The width of the protrusion of the separating protrusion 56*b* is also greater than the thickness of first power terminal 31*b* made of a tab terminal.

Also when the moving housing 50 is located at the mating released position, the separating protrusion 56*b* enters the space between the pair of elastic contact arms 61*ba* of the second power terminal 60, and keeps pushing out the space between the pair of elastic contact arms 61*ba*. Hence, when the moving housing 50 is located at the mating released position, the pair of elastic contact arms 61*ba* are prevented from contacting the first power terminal 31*b*.

Figure 19:
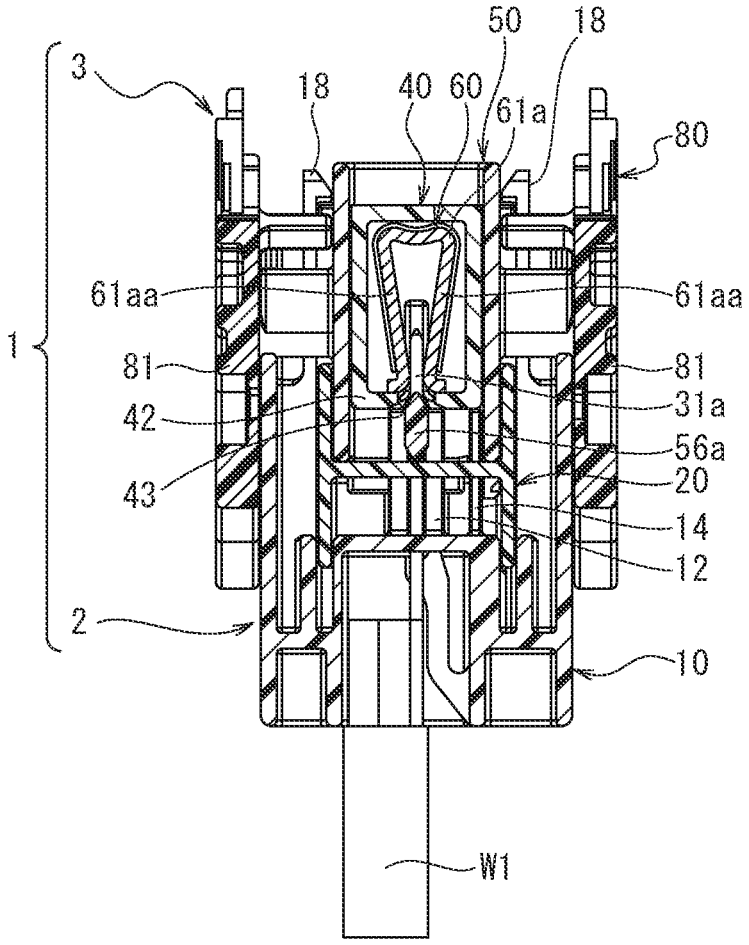
FIG. 19 is a front sectional view of the connector assembly of FIG. 17.

As shown in FIG. 19, while the moving housing 50 is moving to the intermediate position, the separating protrusion 56*a* moves out of the space between the pair of elastic contact arms 61*aa* of the second power terminal 60. Then, the space between the pair of elastic contact arms 61*aa* is narrowed and the pair of elastic contact arms 61*aa* are brought into contact with the first power terminal 31*a* attached to the first housing 10. Similarly, while the moving housing 50 is moving to the intermediate position, the separating protrusion 56*b* also moves out of the space between the pair of elastic contact arms 61*ba* of the second power terminal 60. Then, the space between the pair of elastic contact arms 61*ba* is narrowed and the pair of elastic contact arms 61*ba* are brought into contact with the first power terminal 31*b* attached to the first housing 10.

It is to be noted that the separating protrusions 56*a* and 56*b* move together with the moving housing 50 when the moving housing 50 moves to the mating completed position from the intermediate position. In this situation, the pair of elastic contact arms 61*aa* and 61*ba* respectively keep contacting the first power terminals 31*a* and 31*b*.

The separating protrusion 56*a* enters the space between the pair of elastic contact arms 61*aa* of the second power terminal 60, while the moving housing 50 is moving to the mating released position from the intermediate position. Accordingly, the space between the pair of elastic contact arms 61*aa* is enlarged to bring the pair of elastic contact arms 61*aa* not to contact the first power terminal 31*a*. Similarly, the separating protrusion 56*b* also enters the space between the pair of elastic contact arms 61*ba* of the second power terminal 60, while the moving housing 50 is moving to the mating released position from the intermediate position. Accordingly, the space between the pair of elastic contact arms 61*ba* is enlarged to bring the pair of elastic contact arms 61*ba* not to contact the first power terminal 31*b*.

As shown in FIG. 6, the second signal terminal 70 includes a plate-shaped housing securing portion 71, and a pair of contact portions 71*a* and 71*b* extending downward from a lower end of the housing securing portion 71. The second signal terminal 70 is made by stamping a metal plate. As shown in FIG. 18, the second signal terminal 70 is configured such that the housing securing portion 71 is press-fit and secured into the second signal terminal attachment 52 of the moving housing 50, and the pair of contact portions 71*a* and 71*b* protrude downward with being exposed.

As shown in FIG. 21, when the moving housing 50 reaches the mating completed position, to be precise, while the moving housing 50 is moving to the mating completed position, the contact portion 71*a* of the pair of contact portions 71*a* and 71*b* of the second signal terminal 70 contacts the first signal terminal 32*a*. Also, while the moving housing 50 is moving to the mating completed position, the contact portion 71*b* of the second signal terminal 70 contacts the first signal terminal 32*b*. It is to be noted that the pair of contact portions 71*a* and 71*b* of the second signal terminal 70 do not contact the pair of first signal terminals 32*a* and 32*b*, respectively, while the moving housing 50 is moving from the mating completed position to the intermediate position.

As shown in FIG. 6, the lever 80 includes a pair of leg portions 81, and a coupling portion 82 configured to couple the leg portions 81 at ends of the pair of leg portions 81. The lever 80 is integrally formed by molding a synthetic resin. In addition, a spindle opening 83 through which the spindle 53 of the moving housing 50 passes is arranged at each of the leg portions 81 of the lever 80. The lever 80 is pivotally mounted by the spindle 53 of the moving housing 50. At each of the leg portions 81, a cam groove 84 is arranged to be in cam engagement with a cam shaft 15 provided at the first housing 10.

Figure 3:
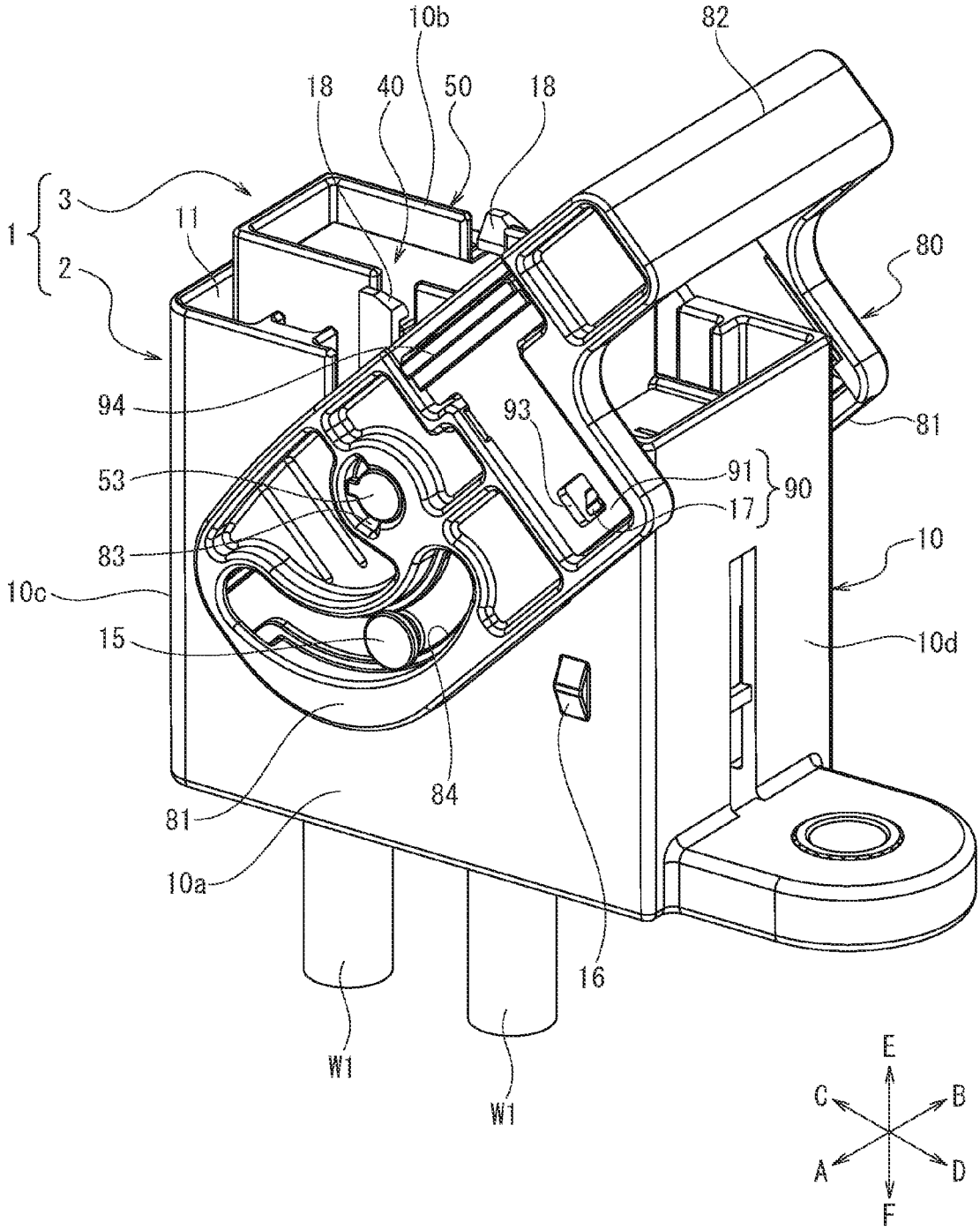
FIG. 3 is a perspective view of the connector assembly of FIG. 1 with the lever at a lever intermediate position and the moving housing at an intermediate position.
Figure 4:
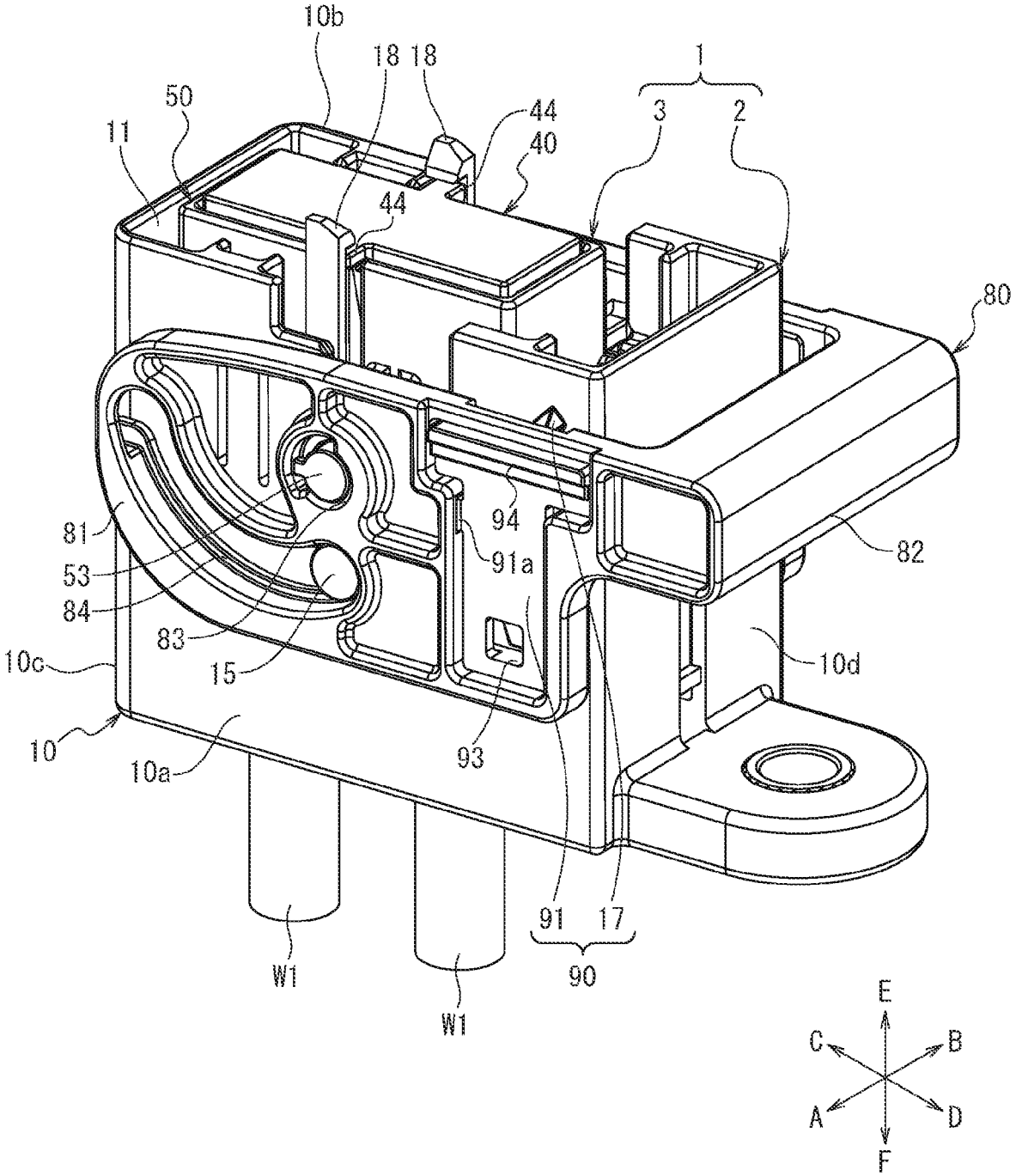
FIG. 4 is a perspective view of the connector assembly of FIG. 1 with the lever at a lever mating completed position and the moving housing at a mating completed position.
Figure 13:
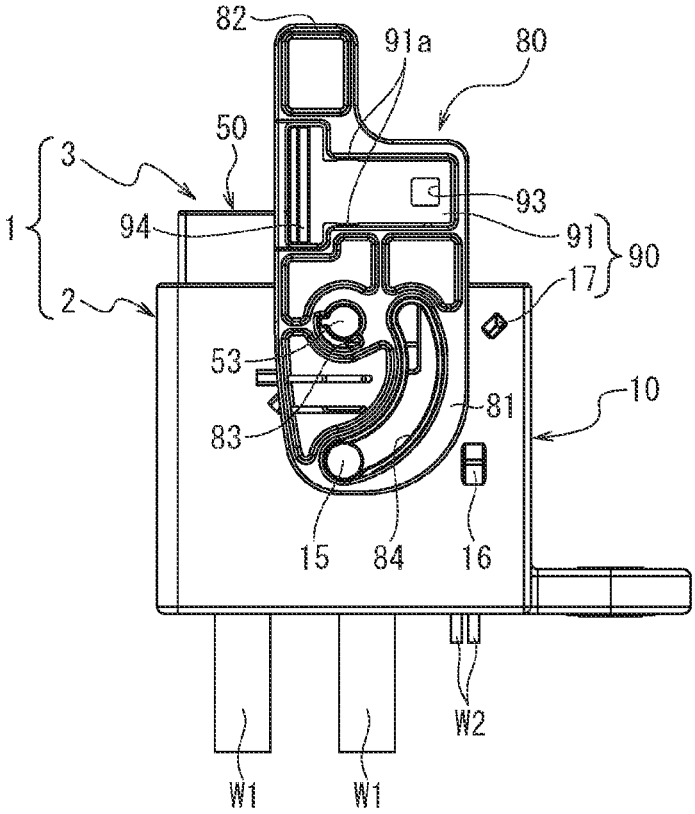
FIG. 13 is a front view of the connector assembly of FIG. 1 with the lever at the lever mating released position and the moving housing at the mating released position.
Figure 17:
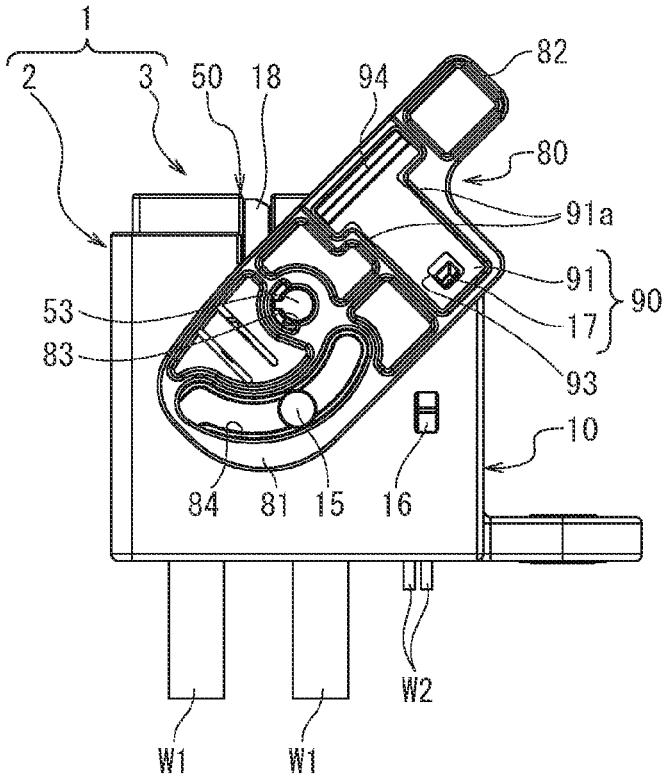
FIG. 17 is a front view of the connector assembly of FIG. 1 with the lever at the lever intermediate position and the moving housing at the intermediate position.
Figure 20:
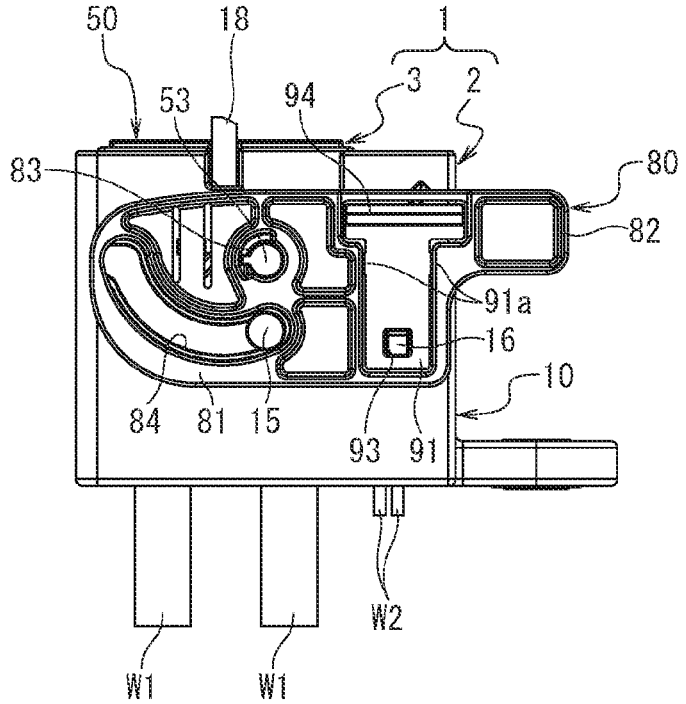
FIG. 20 is a front view of the connector assembly of FIG. 1 with the lever at the lever mating completed position and the moving housing at the mating completed position.

In addition, the lever 80 is rotated between a lever mating released position shown in FIGS. 2 and 13, a lever intermediate position illustrated in FIGS. 3 and 17, and a lever mating completed position illustrated in FIGS. 4 and 20, with the cam shaft 15 provided at the first housing 10 in engagement with the cam groove 84. The lever intermediate position is located at a rotating angle of about 45 degrees from the lever mating released position. The lever mating completed position is located at a rotating angle of about 90 degrees from the lever mating released position. When the lever 80 is located at the lever mating released position, the moving housing 50 is located at the mating released position described above. In addition, when the lever 80 is located at the lever intermediate position, the moving housing 50 is located at the intermediate position described above. Further, when the lever 80 is located at the lever mating completed position, the moving housing 50 is located at the mating completed position described above.

Figure 29:
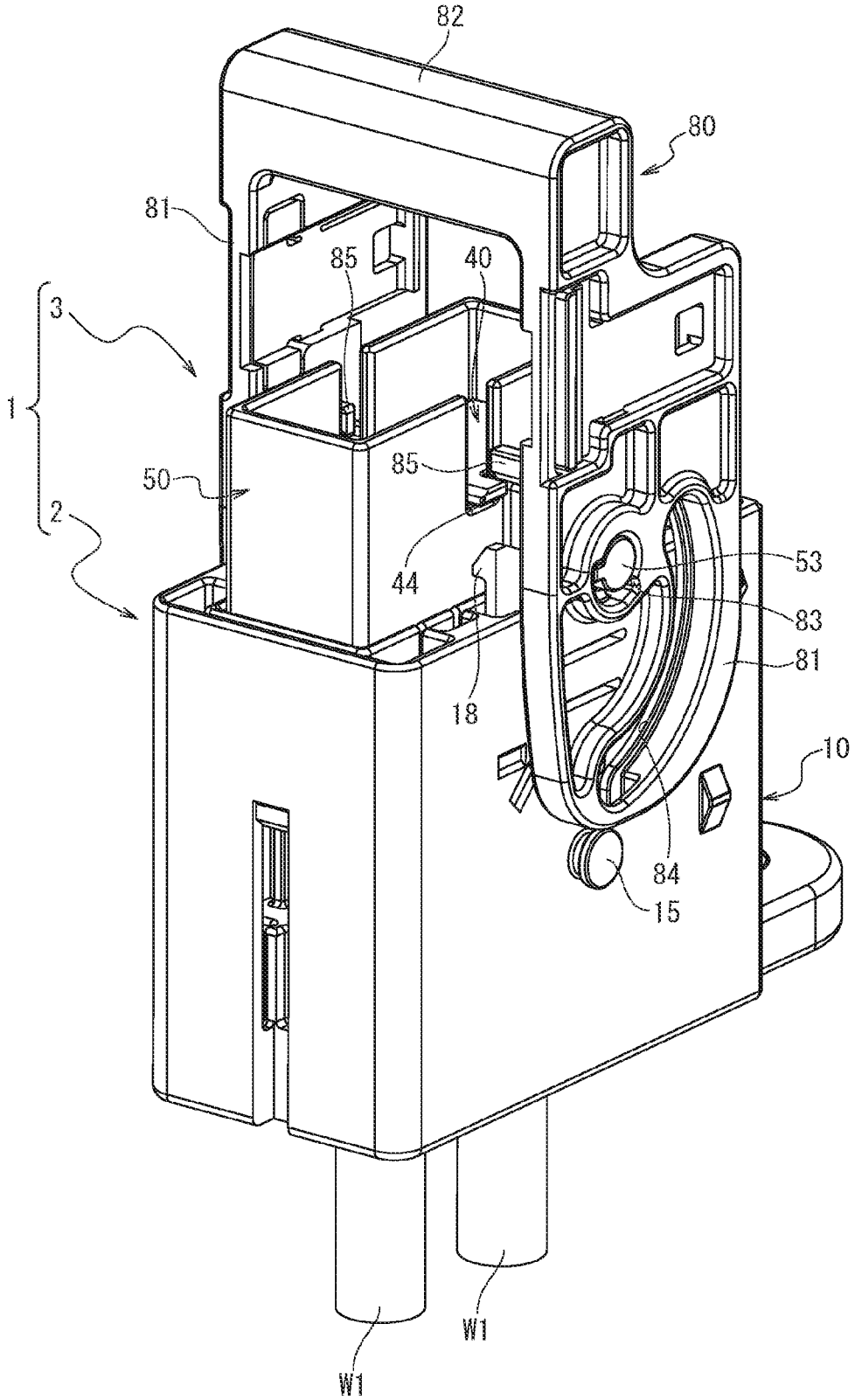
FIG. 29 is a perspective view of the connector assembly of FIG. 1 with the second connector separated from the first connector.

As shown in FIGS. 16 and 29, an unlock portion 85 is provided on the inner face of each of the leg portions 81 of the lever 80. The unlock portion 85 is configured to release the movement restriction state where a second housing lock portion 18 restricts the movement of the second housing 40. The unlock portion 85 includes a shaft portion arranged on the inner face of each of the leg portions 81 and extending inward, and the unlock portion 85 is closer to the coupling portion 82 than the spindle opening 83.

Figure 25:
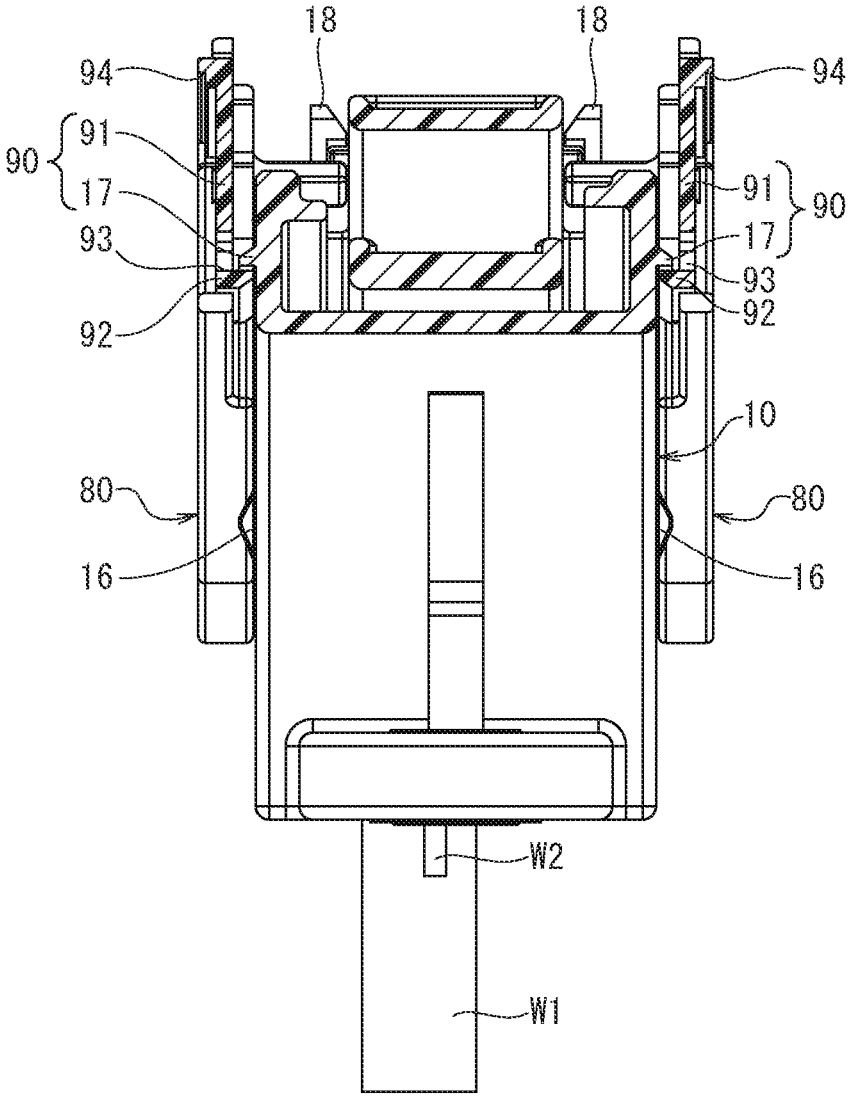
FIG. 25 is a front sectional view of the connector assembly of FIG. 1 with the lever at the lever intermediate position.

As shown in FIGS. 3, 17, and 25, the lever 80 and the first housing 10 include a time lag lock mechanism 90 configured to lock the rotation of the lever 80 and also configured to release the locking of the lever 80, when the lever 80 is located at the lever intermediate position. The time lag lock mechanism 90 includes a pair of time lag projections 17 and a pair of time lag lock arms 91. The pair of time lag projections 17 are respectively arranged on the front wall 10*a* and the rear wall 10*b* of the housing 10. The pair of time lag lock arms 91 are arranged at the lever 80, and each of the pair of time lag lock arms 91 includes an engagement portions 92 configured to engage each of the pair of time lag projections 17.

Each of the pair of time lag lock arms 91 is arranged at the lever 80 to be tiltable with respect to the lever 80, with a support portion 91*a* being as the center. As shown in FIG. 25, each of the time lag lock arms 91 includes an engagement portion 92 arranged on the inner face on one side of the support portion 91*a*, a pressing operation portion 94 arranged on the outer face on the other side of the support portion 91*a*, and the support portion 91*a* interposed between the engagement portion 92 and the pressing operation portion 94. The engagement portion 92 is formed to protrude inward from the inner face on the other side of the time lag lock arm 91. When the pressing operation portion 94 is pressed inward from the outside, the other side of the time lag lock arm 91 is displaced outward with the support portion 91*a* being as the center. This configuration displaces the engagement portion 92 outward, and releases the engagement of the engagement portion 92 with the time lag projection 17.

An opening 93 is arranged in the vicinity of the engagement portion 92 of each of the pair of time lag lock arms 91. The opening 93 allows checking of the time lag projection 17 from the outside, when the lever 80 is located at the lever intermediate position. In addition, the opening 93 allows checking of the signal terminal contact projection 16 from the outside, when the lever 80 is located at the lever mating completed position.

When the lever 80 is rotated to the lever intermediate position from the lever mating completed position, the engagement portion 92 engages with the time lag projection 17, and the rotation of the lever 80 is locked. At the lever intermediate position, the moving housing 50 is located at the intermediate position. The pair of contact portions 71*a* and 71*b* of the second signal terminal 70 are respectively not in contact with the pair of first signal terminals 32*a* and 32*b*. Then, in order to rotate the lever 80 from the lever intermediate position to the lever mating released position to separate the second connector 3 from the first connector 2, the pressing operation portion 94 of the time lag lock arm 91 is pressed inward from the outside (i.e., a locking release operation). Accordingly, after the engagement of the engagement portion 92 with the time lag projection 17 is released, the lever 80 is rotated toward the lever mating released position. Then, the moving housing 50 moves to the mating released position from the intermediate position. While the moving housing 50 is moving, the second power terminal 60 does not contact the pair of first power terminals 31*a* and 31*b*.

After the contact state of the second signal terminal 70 with the pair of first signal terminals 32*a* and 32*b* is released, until the contact state of the second power terminal 60 with the pair of first power terminals 31*a* and 31*b* is released, the lever 80 is locked by the time lag lock mechanism 90. Therefore, a certain time lag can be arranged, after the pair of first signal terminals 32*a* and 32*b* and the second signal terminal 70 are disconnected, until the pair of first power terminals 31*a* and 31*b* and the second power terminal 60 are disconnected.

Figure 23:
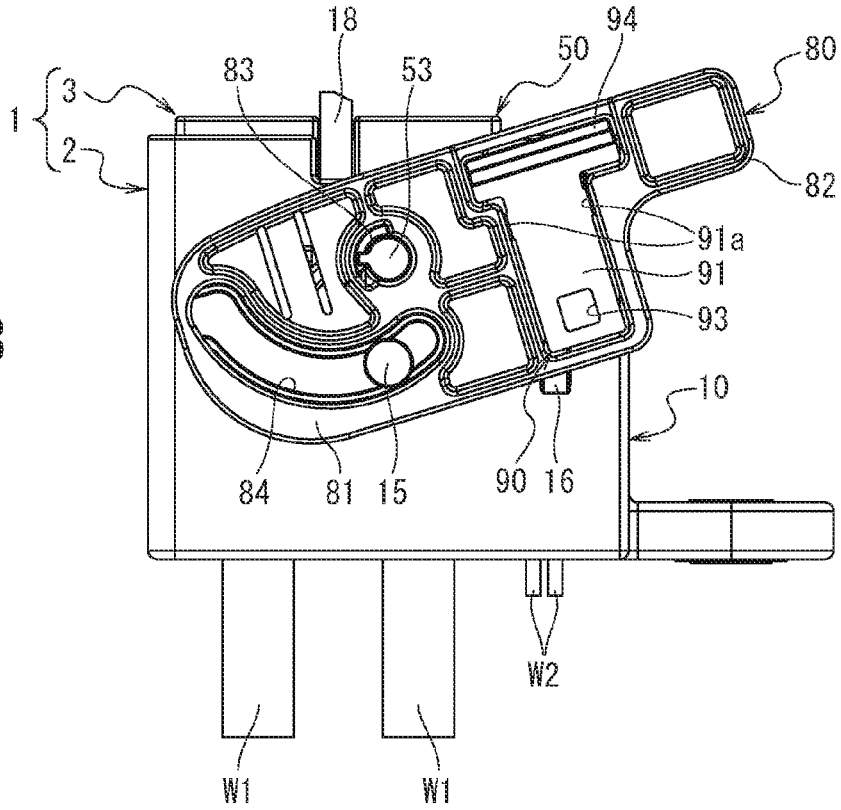
FIG. 23 is a sectional view of the connector assembly of FIG. 1 with the lever at a position between the lever intermediate position and the lever mating completed position.
Figure 24:
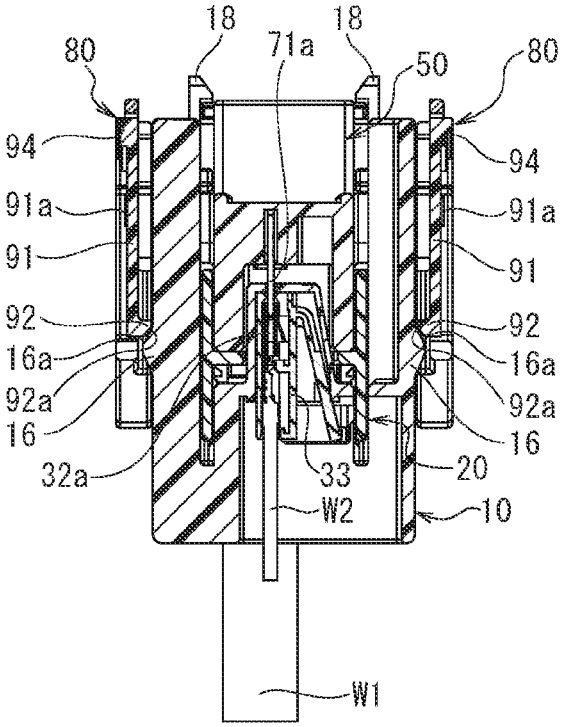
FIG. 24 is a front sectional view of the connector assembly of FIG. 23.

A slanted face 92*a* is arranged at an end of the engagement portion 92 of the time lag lock arm 91, on the side opposing the signal terminal contact projection 16, as shown in FIG. 24. On the other hand, the signal terminal contact projection 16 is formed to have a substantially triangular shape. A slanted face 92*a* to be in contact with the slanted face 92*a* is arranged on the side opposing the engagement portion 92. Here, when the lever 80 is rotated from the lever intermediate position shown in FIG. 17 to the lever mating completed position shown in FIG. 20, the lever 80 moves through the position shown in FIG. 23. In this position, as shown in FIG. 24, the pair of contact portions 71*a* and 71*b* of the second signal terminal 70 are respectively in contact with the pair of first signal terminals 32*a* and 32*b*. However, in this position, the slanted face 92*a* of the engagement portion 92 of the time lag lock arm 91 abuts with a slanted face 16*a* of the signal terminal contact projection 16. For this reason, when the slanted face 92*a* of the engagement portion 92 moves over the slanted face 16*a* of the signal terminal contact projection 16, a reaction force is generated from the signal terminal contact projection 16, and such a reaction force pushes back the time lag lock arm 91, in other words, the lever 80. Hence, when the lever 80 is rotated by a force smaller than the reaction force, the lever 80 is pushed back. The contact state of contacting the second signal terminal 70 with the pair of first signal terminals 32*a* and 32*b* is prevented. This configuration prevents half-mating of the signal terminals. Only when the lever 80 is rotated by a force greater than the above-described reaction force, the engagement portion 92 moves over the signal terminal contact projection 16, and then the lever 80 reaches the lever mating completed position. In this situation, the pair of contact portions 71*a* and 71*b* of the second signal terminal 70 are respectively in contact with the pair of first signal terminals 32*a* and 32*b* with certainty.

The operation of mating the second connector 3 with the first connector 2 and the operation of separating the second connector 3 from the first connector 2 will now be described in greater detail with reference to FIGS. 1-4 and 13-29.

The first connector 2 is mounted on a vehicle equipped with a high-voltage battery, such as an electric vehicle or a hybrid vehicle. As shown in FIGS. 1-4, by rotating the lever 80, the first connector 2 is mated with the second connector 3 to connect a high-voltage part. As also shown in FIGS. 1-4, by rotating the lever 80, the second connector 3 is separated from the first connector 2 to disconnect the high-voltage part.

First, when the second connector 3 is mated with the first connector 2, the coupling portion 82 of the lever 80 is set at the top of the second connector 3, as shown in FIG. 1. In this state, the moving housing 50 of the second connector 3 is inserted into the second connector receiving recess 11 of the first housing 10 in the spacer 20. In the insertion, the cam shafts 15 arranged at the first housing 10 are respectively inserted into the cam grooves 84 of the lever 80.

Here, in inserting the moving housing 50 into the second connector receiving recess 11, the separating protrusions 56*a* and 56*b* respectively enter the spaces between the pair of elastic contact arms 61*aa* and 61*ba* of the second power terminal 60, and respectively push out the spaces between the pair of elastic contact arms 61*aa* and 61*ba*. Accordingly, the pair of elastic contact arms 61*aa* and 61*ba* respectively permit the first power terminals 31*a* and 31*b* to enter the spaces between the pair of elastic contact arms 61*aa* and 61*ba* without contacting. In the insertion, the first power terminals 31*a* and 31*b* enter the spaces between the pair of elastic contact arms 61*aa* and 61*ba* from the slit 43 of the second housing 40.

When the moving housing 50 is inserted into the second connector receiving recess 11, as shown in FIGS. 2 and 13, the lever 80 is located at the lever mating released position, and the moving housing 50 is located at the mating released position. The pair of spindles 53 are inserted into the notches 10*f* from the upper side. When the moving housing 50 is located at the mating released position, the second housing 40 abuts with the upper ends of the first power terminal attachment 12 and the second housing insertion restricting portion 14 of the first housing 10, as shown in FIG. 16. This configuration restricts the downward movement of the second housing 40, in other words, the insertion direction of the second housing 40.

When the moving housing 50 is located at the mating released position, the separating protrusions 56*a* and 56*b* respectively enter the spaces between the pair of elastic contact arms 61*aa* and 61*ba* of the second power terminal 60 to keep pushing out the spaces between the pair of elastic contact arm 61*aa* and 61*ba*, as shown in FIGS. 15 and 16. Thus, when the moving housing 50 is located at the mating released position, the pair of elastic contact arms 61*aa* and 61*ba* are prevented from contacting the first power terminals 31*a* and 31*b*. In addition, as shown in FIG. 14, the contact portions 71*a* and 71*b* of the second signal terminal 70 are not brought into contact with the first signal terminals 32*a* and 32*b*, respectively.

Figure 27:
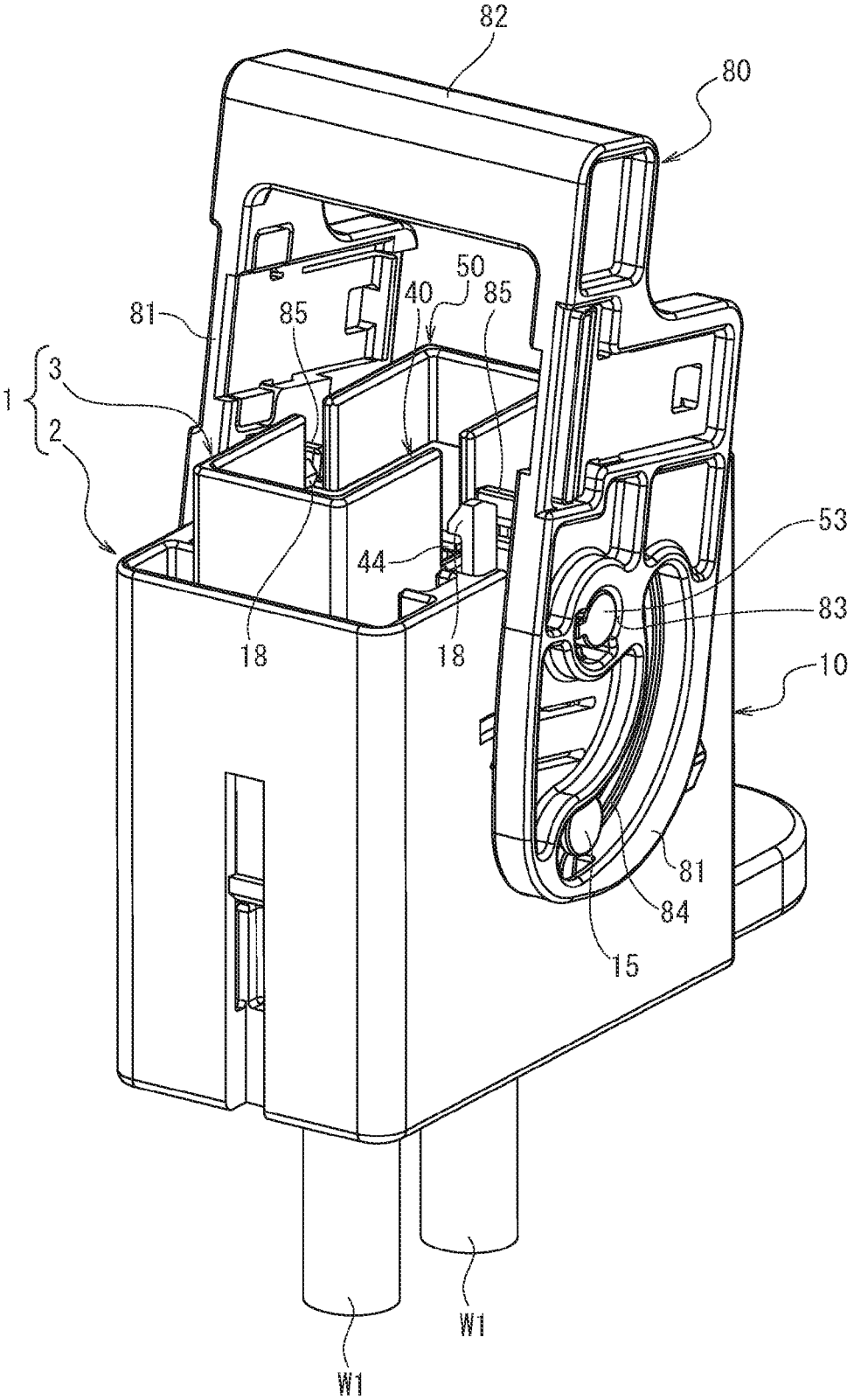
FIG. 27 is a perspective view of the connector assembly of FIG. 1 when the lever is at a position just before the lever mating released position.

When the lever 80 is rotated from the lever mating released position to a rotating angle of about 10 degrees shown in FIG. 27, the pair of the second housing lock portions 18 respectively lock the pair of lock plate portions 44 of the second housing 40 from above. This configuration restricts the movement of the second housing 40 in an opposite direction to insertion direction of the second housing 40.

Next, as shown in FIGS. 3 and 17, the lever 80 is further rotated to locate the lever 80 at the lever intermediate position. At this position, the distance between the spindle 53 of the lever 80 and the cam shaft 15 arranged at the first housing 10 becomes shorter. Hence, the moving housing 50 moves to the intermediate position on the depth side (i.e., lower side) in the insertion direction from the mating released position. While the moving housing 50 is moving to the intermediate position from the mating released position, the separating protrusions 56*a* and 56*b* are respectively withdrawn from between the pair of elastic contact arms 61*aa* and 61*ba* of the second power terminal 60. When the moving housing 50 reaches the intermediate position, as shown in FIG. 19, the separating protrusions 56*a* and 56*b* are completely withdrawn from between the pair of elastic contact arms 61*aa* and 61*ba* of the second power terminal 60, respectively. Accordingly, the spaces between the pair elastic contact arms 61*aa* and 61*ba* are narrowed to bring the pair of elastic contact arms 61*aa* and 61*ba* into contact with the power terminals 31*a* and 31*b*, respectively. This configuration allows the first power terminal 31*a* and the first power terminal 31*b* to be electrically connected by the second power terminal 60, so that the high-voltage portions are connected. On the other hand, as shown in FIG. 18, the pair of contact portions 71*a* and 71*b* of the second signal terminal 70 are not in contact with the first signal terminals 32*a* and 32*b*, respectively.

As described above, the second power terminal 60 contacts the first power terminals 31*a* and 31*b* without sliding. When the second connector 3 is mated with the first connector 2, the first power terminals 31*a* and 31*b* and the second power terminal 60 can be prevented from being damaged.

The second power terminal 60 includes the pair of elastic contact arms 61*aa* and 61*ba* respectively configured to receive and contact the first power terminals 31*a* and 31*b*, each of which is made of a male tab terminal, between the pair of elastic contact arms 61*aa* and 61*ba*. Each of the separating protrusions 56*a* and 56*b* includes a protrusion having a width greater than the thickness of the tab terminal. The separating protrusions 56*a* and 56*b* respectively enter the spaces between the pair of elastic contact arms 61*aa* and 61*ba* of the second power terminal 60, when the moving housing 50 is located at the mating released position. This configuration enlarges the spaces between the pair of elastic contact arms 61*aa* and 61*ba*, so that the pair of elastic contact arms 61*aa* and 61*ba* respectively contact the first power terminals 31*a* and 31*b*. The separating protrusions 56*a* and 56*b* are respectively withdrawn from between the pair elastic contact arms 61*aa* and 61*ba*, while the moving housing 50 is moving from the mating released position to the intermediate position. Accordingly, the spaces between the pair of elastic contact arms 61*aa* and 61*ba* are respectively narrowed to bring the pair of elastic contact arms 61*aa* and 61*ba* into contact with the first power terminals 31*a* and 31*b*. In such a simple configuration, the functionalities of the separating protrusions are achieved by the second power terminal 60 and the separating protrusions 56*a* and 56*b*.

Figure 22:
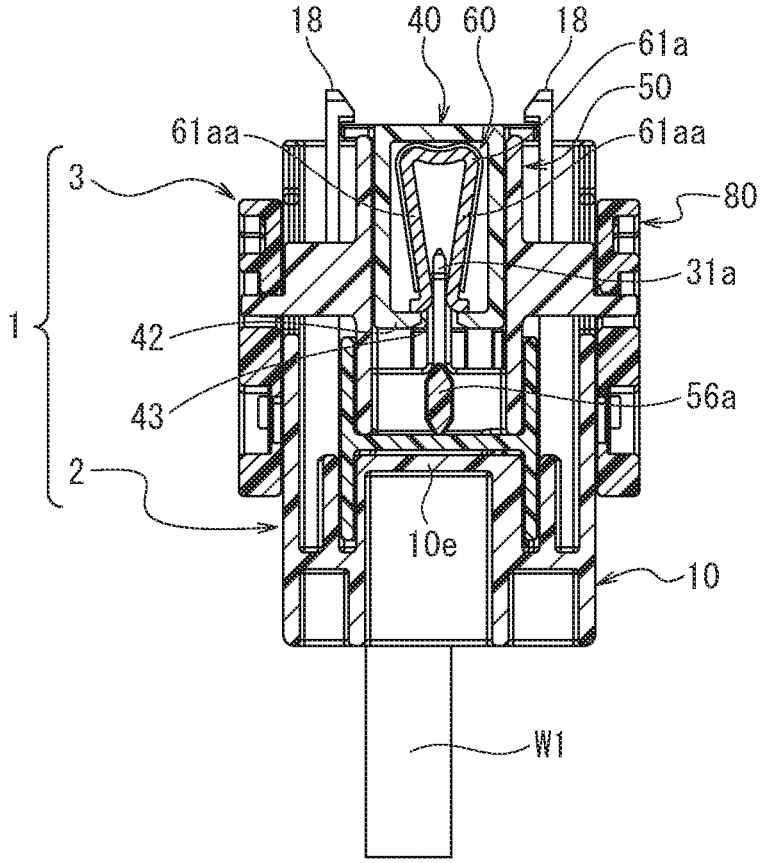
FIG. 22 is a front sectional view of the connector assembly of FIG. 20.

Next, as shown in FIGS. 4 and 20, the lever 80 is further rotated to locate the lever 80 at the lever mating completed position. As the distance between the spindle 53 of the lever 80 and the cam shaft 15 arranged at the first housing 10 shortens, the moving housing 50 is moved to the mating completed position on the depth side (i.e., the lower side) in the insertion direction from the intermediate position. While the moving housing 50 is moving to the mating completed position, the pair of contact portions 71*a* and 71*b* of the second signal terminal 70 are respectively brought into contact with the first signal terminals 32*a* and 32*b*. When the moving housing 50 reaches the mating completed position, the pair of contact portions 71*a* and 71*b* of the second signal terminal 70 respectively keep contacting the first signal terminals 32*a* and 32*b* as shown in FIG. 21. This configuration allows the first signal terminals 32*a* and 32*b* to be electrically connected by the second signal terminal 70. On the other hand, the pair of elastic contact arms 61*aa* and 61*ba* of the second power terminal 60 respectively keep contacting the first power terminals 31*a* and 31*b* as shown in FIG. 22

The lever 80 moves through the positions shown in FIGS. 23 and 24 from the lever intermediate position shown in FIG. 17 to the lever mating completed position shown in FIG. 20. When the slanted face 92*a* of the engagement portion 92 of the time lag lock arm 91 moves over the slanted face 16*a* of the signal terminal contact projection 16, the reaction force that pushes back the lever 80 is generated. Therefore, as described above, the lever 80 needs to be rotated by a force greater than the reaction force. Then, the engagement portion 92 of the time lag lock arm 91 moves over the signal terminal contact projection 16, and then the lever 80 reaches the lever mating completed position. In this situation, the operator is able to confirm the mating completion by hearing the sound generated when the engagement portion 92 of the time lag lock arm 91 moves over the signal terminal contact projection 16 and with the click haptic feedback. The second connector 3 is thus mated with the first connector 2.

When the second connector 3 is separated from the first connector 2, the lever 80 is rotated reversely to locate the lever 80 from the lever mating completed position shown in FIG. 20 to the lever intermediate position shown in FIG. 17. Accordingly, the distance between the spindle 53 of the lever 80 and the cam shaft 15 arranged at the first housing 10 becomes longer. The moving housing 50 moves to the intermediate position on the near side in the insertion direction (i.e., upper side) from the mating completed position. Here, the pair of elastic contact arms 61*aa* and 61*ba* of the second power terminal 60 respectively keep contacting the first power terminals 31*a* and 31*b*. On the other hand, while the moving housing 50 is moving to the intermediate position, the pair of contact portions 71*a* and 71*b* of the second signal terminal 70 do not contact the first signal terminals 32*a* and 32*b*, respectively. This configuration does not permit the electrical current to flow across the first power terminals 31*a* and 31*b* or the second power terminal 60. When the moving housing 50 reaches the intermediate position, the pair of contact portions 71*a* and 71*b* of the second signal terminal 70 respectively keep non-contact states with the first signal terminals 32*a* and 32*b*, as shown in FIG. 18

When the lever 80 is rotated to the lever intermediate position from the lever mating completed position, the engagement portion 92 of the time lag lock arm 91 engages the time lag projection 17 to lock the rotation of the lever 80, as shown in FIG. 25. For this reason, in order to rotate the lever 80 from the lever intermediate position to the lever mating released position, the pressing operation portion 94 of the time lag lock arm 91 is pressed inward from the outside to release the engagement of the time lag projection 17 with the engagement portion 92.

The lever 80 is then rotated from the lever intermediate position shown in FIG. 17 to the lever mating released position shown in FIG. 13. Accordingly, as the distance between the spindle 53 of the lever 80 and the cam shaft 15 arranged at the first housing 10 becomes further longer, the moving housing 50 moves to the mating released position on the near side in the insertion direction (i.e., the upper side) from the intermediate position. In this situation, while the moving housing 50 is moving to the mating released position, the separating protrusions 56*a* and 56*b* respectively enter the spaces between the pair of elastic contact arms 61*aa* and 61*ba* of the second power terminal 60. When the separating protrusions 56*a* and 56*b* respectively enter the spaces between the pair of elastic contact arms 61*aa* and 61*ba* of the second power terminal 60, the second housing lock portions 18 restrict the upward movement of the second housing 40. When the second housing lock portion 18 keeps restricting the upward movement of the second housing 40, the second housing 40 cannot be separated from the first connector 2.

Figure 26:
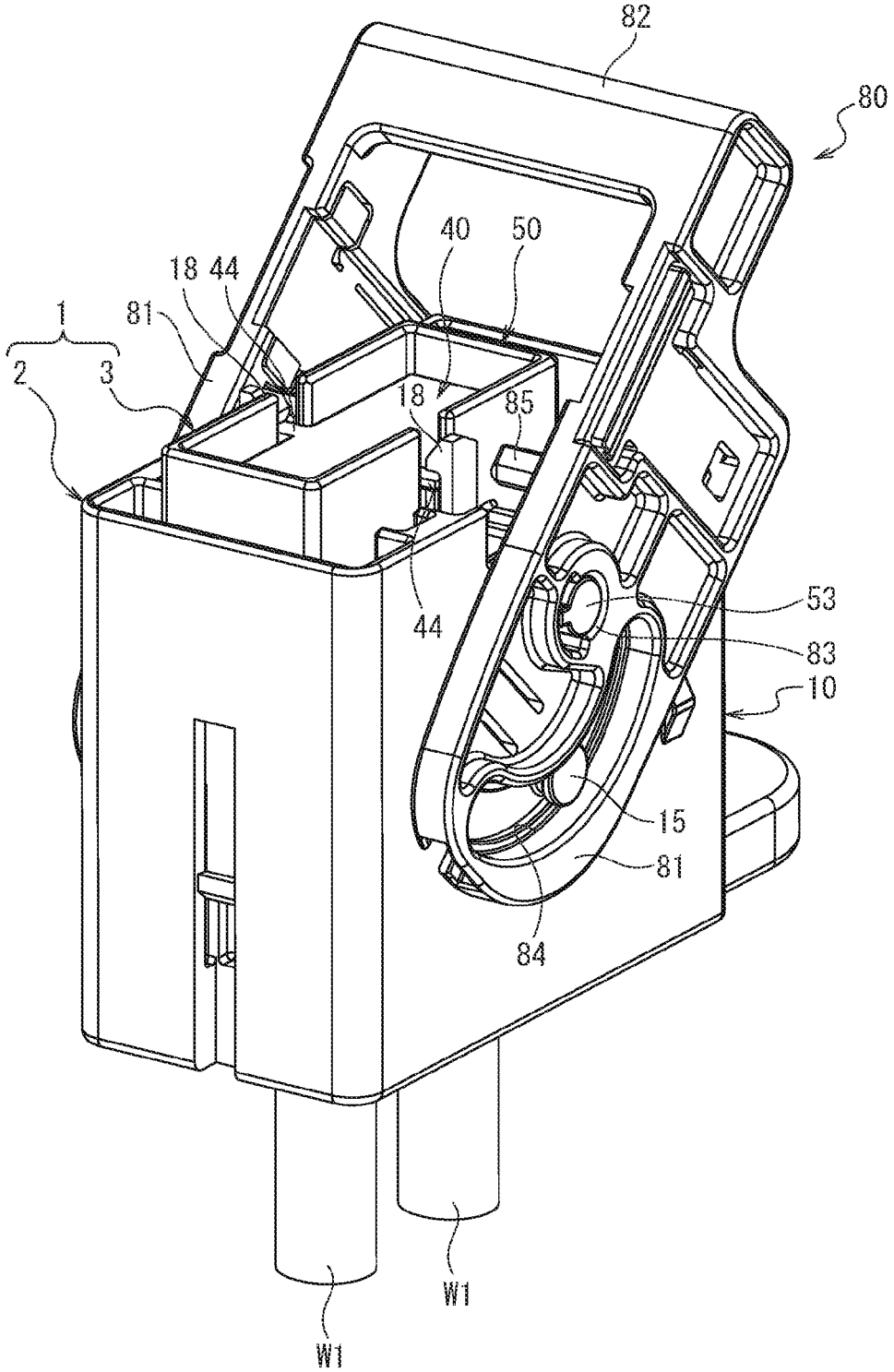
FIG. 26 is a perspective view of the connector assembly of FIG. 1 with the lever at the lever intermediate position.

When the lever 80 is rotated from the lever mating completed position to the lever intermediate position, each unlock portion 85 gets closer to the second housing lock portions 18, but does not abut the second housing lock portions 18, as shown in FIG. 26. Therefore, the second housing lock portions 18 keeps the state of restricting the movement of the second housing 40.

Figure 28:
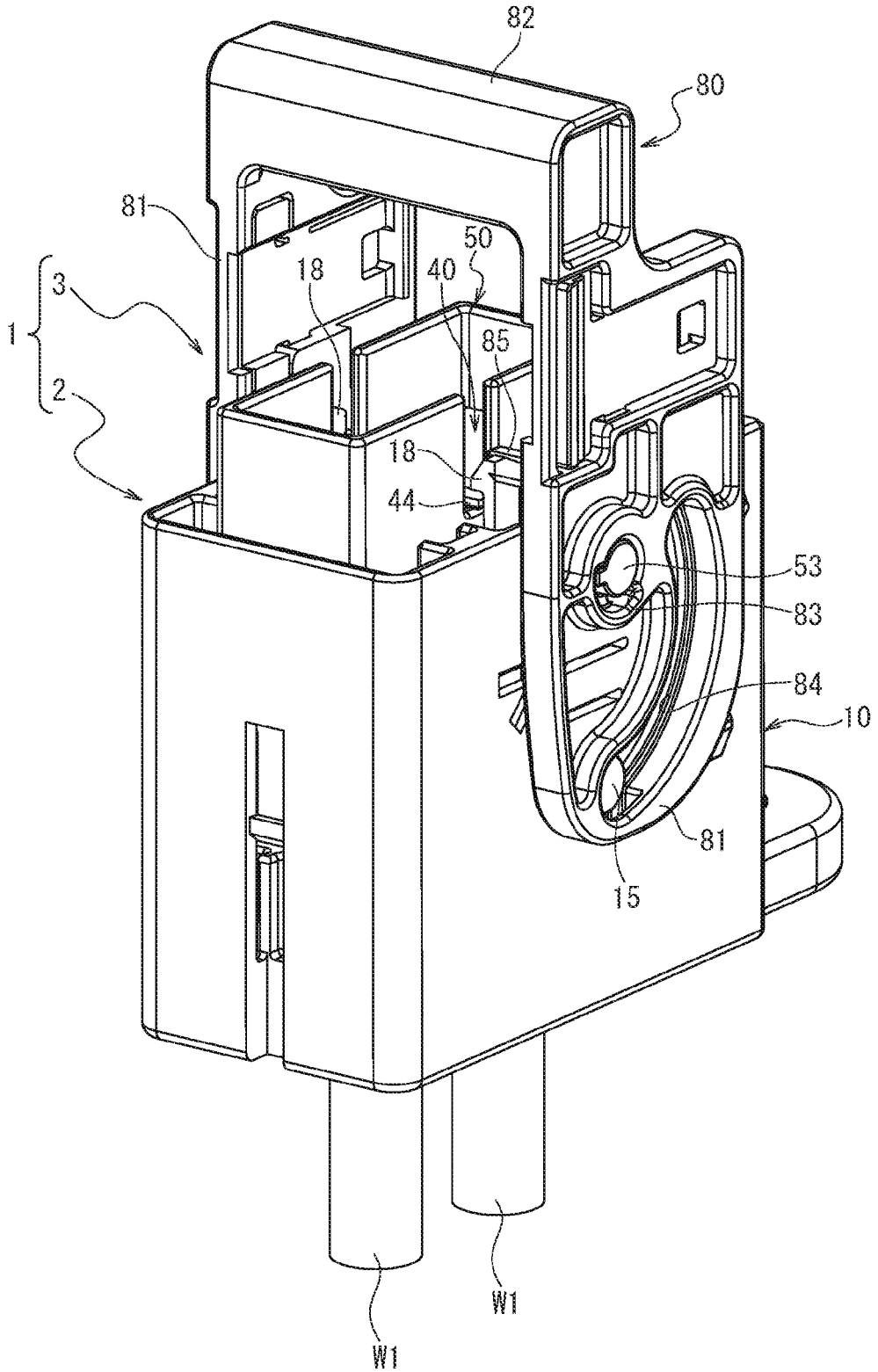
FIG. 28 is a perspective view of the connector assembly of FIG. 1 with the lever at the lever mating released position.

When the moving housing 50 reaches the mating released position, the separating protrusions 56*a* and 56*b* have completely entered the spaces between the pair of elastic contact arms 61*aa* and 61*ba* of the second power terminal 60, respectively, as shown in FIG. 15. This configuration enlarges the spaces between the pair of elastic contact arms 61*aa* and 61*ba* to respectively cause the pair of elastic contact arms 61*aa* and 61*ba* not to contact the first power terminals 31*a* and 31*b*. The high-voltage portions are accordingly separated. On the other hand, the pair of contact portions 71*a* and 71*b* of the second signal terminal 70 respectively keep non-contact states with the first signal terminals 32*a* and 32*b*. When the lever 80 is rotated to the lever mating released position, the unlock portions 85 respectively displace the second housing lock portions 18 to release the locked state of the second housing 40 by the second housing lock portions 18, as shown in FIG. 28. Such a configuration enables the second connector 3 to be separated from the first connector 2, as shown in FIG. 29.

Embodiments of the present invention have been described above, but various changes and modifications are possible.

For example, each of the first power terminals 31*a* and 31*b* is not necessarily made of a male tab terminal, and the second power terminal 60 does not necessarily include the pair of elastic contact arm 61*aa* and 61*ba* that respectively receive the first power terminals 31*a* and 31*b* to contact the first power terminals 31*a* and 31*b*. The first power terminal may be a female type, whereas the second power terminal may be a male type. The separating protrusions 56*a* and 56*b* may not necessarily include protrusions each having a width greater than the thickness of the tab terminal.

The time lag lock mechanism 90 may not necessarily include the time lag projection 17 or the time lag lock arm 91, and any configuration that locks the rotation of the lever 80 and that also releases the locking of the lever 80 is applicable, when the lever 80 is located at the lever intermediate position. In arranging the time lag lock arm 91, the time lag lock arm 91 is not necessarily arranged at the lever 80 to be tiltable with the support portion 91*a* being as the center.

The second housing lock portions 18 may be disposed on an element other than the first housing 10. The unlock portion 85 may be disposed on an element other than the lever 80. The lever intermediate position may be a rotating angle other than a rotating angle of about 45 degrees from the lever mating released position, and the lever mating completed position may be a rotating angle other than a rotating angle of 90 degrees from the lever mating released position.

Advantageously, according to the connector assembly 1 of the present invention, the time lag lock mechanism 90 is configured to lock the rotation of the lever 80 at the intermediate position, providing a time lag between when the first signal terminal 32 and the second signal terminal 70 are disconnected and when the first power terminal 31 and the second power terminal 60 are disconnected.

Further, the separating protrusion 56 is configured to prevent the second power terminal 60 from contacting the first power terminal 31 in the mating released position and bring the second power terminal 60 into contact with the first power terminal 31 at the intermediate position, the second power terminal 60 thus contacting the first power terminal 31 without sliding. Consequently, in both mating and separation of the second connector 3 and the first connector 2, the first power terminal 31 and the second power terminal 60 can be prevented from being damaged.

What is claimed is:

1. A connector assembly, comprising:

a first connector having a first housing, a first power terminal attached to the first housing, and a first signal terminal attached to the first housing; and a second connector matable with the first connector, the second connector having:

a lever attached to a moving housing, the lever moving the moving housing between a mating released position, an intermediate position, and a mating completed position;

a second housing movably disposed within the moving housing, the second housing inserted into the first housing in the mating released position;

a second power terminal disposed in the second housing and contacting the first power terminal in the intermediate position;

a second signal terminal attached to the moving housing and contacting the first signal terminal at a position between the intermediate position and the mating completed position; and a separating protrusion disposed on the moving housing preventing the second power terminal from contacting the first power terminal in the mating released position.

2. The connector assembly of claim 1, wherein the lever rotates between a lever mating released position locating the moving housing at the mating released position, a lever intermediate position locating the moving housing at the intermediate position, and a lever mating completed position locating the moving housing at the mating completed position.

3. The connector assembly of claim 2, wherein a time lag lock mechanism is disposed on the first housing and the lever.

4. The connector assembly of claim 3, wherein, when the lever is located at the lever intermediate position, the time lag lock mechanism is capable of locking and releasing rotation of the lever.

5. The connector assembly of claim 4, wherein the time lag lock mechanism has a time lag projection disposed on the first housing and a time lag lock arm disposed on the lever including an engagement portion engaging with the time lag projection.

6. The connector assembly of claim 5, wherein the time lag lock arm has a central support portion attached to the lever.

7. The connector assembly of claim 6, wherein the time lag lock arm is tiltably disposed on the lever.

8. The connector assembly of claim 7, wherein the time lag lock arm has an engagement portion disposed on a first side of the support portion and a pressing operation portion disposed on a second side of the support portion.

9. The connector assembly of claim 1, wherein the first power terminal is a tab terminal, and the second power terminal has a pair of elastic contact arms receiving and contacting the tab terminal between the pair of elastic contact arms.

10. The connector assembly of claim 9, wherein the separating protrusion has a width greater than a thickness of the tab terminal.

11. The connector assembly of claim 10, wherein, in the mating released position, the separating protrusion is disposed between the pair of elastic contact arms and separates the pair of elastic contact arms.

12. The connector assembly of claim 11, wherein, while the moving housing is moved from the mating released position to the intermediate position, the separating protrusion is withdrawn from between the pair of elastic contact arms.

13. The connector assembly of claim 1, wherein movement of the second housing is restricted by the first housing when the second housing is inserted into the first housing.

14. The connector assembly of claim 13, wherein the first housing has a second housing lock portion restricting movement of the second housing in a direction opposite an insertion direction.

15. The connector assembly of claim 14, wherein the lever has an unlock portion releasing the second housing from the second housing lock portion.

* * * * *